US011147726B2

(12) United States Patent
Stryker et al.

(10) Patent No.: US 11,147,726 B2
(45) Date of Patent: Oct. 19, 2021

(54) PERSON SUPPORT APPARATUS SYSTEM

(71) Applicant: Stryker Corporation, Kalamazoo, MI (US)

(72) Inventors: Martin W. Stryker, Kalamazoo, MI (US); Ross Timothy Lucas, Paw Paw, MI (US); Brandon David Naber, Portage, MI (US); Christopher Gentile, Sturgis, MI (US)

(73) Assignee: Stryker Corporation, Kalamazoo, MI (US)

( * ) Notice: Subject to any disclaimer, the term of this patent is extended or adjusted under 35 U.S.C. 154(b) by 797 days.

(21) Appl. No.: 15/664,831

(22) Filed: Jul. 31, 2017

(65) Prior Publication Data

US 2018/0028383 A1 Feb. 1, 2018

Related U.S. Application Data

(60) Provisional application No. 62/369,423, filed on Aug. 1, 2016.

(51) Int. Cl.
*A47G 1/02* (2006.01)
*A61G 7/10* (2006.01)
(Continued)

(52) U.S. Cl.
CPC ..... *A61G 7/1046* (2013.01); *A61G 1/013* (2013.01); *A61G 1/017* (2013.01); *A61G 1/0237* (2013.01);
(Continued)

(58) Field of Classification Search
CPC ..... A61G 1/02; A61G 1/013; A61G 1/017; A61G 1/0237; A61G 1/0268; A61G 7/1046; A61G 7/1074
(Continued)

(56) References Cited

U.S. PATENT DOCUMENTS 2,202,383 A 5/1940 Hymer et al.
2,747,919 A 5/1956 Ferneau et al.
(Continued)

FOREIGN PATENT DOCUMENTS

CA 2481694 A1 10/2003
CN 2548611 Y 5/2003
(Continued)

OTHER PUBLICATIONS

Yanko Design, Caterpillar Stretcher Scoffs Stairs, by Long Tran, dated Aug. 23, 2007.

*Primary Examiner* — Fredrick C Conley
(74) *Attorney, Agent, or Firm* — Warner Norcross + Judd LLP

(57) ABSTRACT

A person support apparatus includes a deck with a seat section, a leg section, and a back section. The back section is pivotally mounted to the seat section. The leg section has a proximal end pivotally mounted to the seat section and a cantilevered end spaced a first distance from its proximal end. The seat section, the leg section, and the back section are arranged to lie in a common plane when the deck is in a supine configuration to support a person in a supine position. A lift is mounted to the seat section of the deck, with the lift being configured to raise the deck relative to a supporting floor surface to a maximum height less than the first distance.

25 Claims, 13 Drawing Sheets

(51) Int. Cl.
*A61G 1/017* (2006.01)
*A61G 1/02* (2006.01)
*A61G 1/013* (2006.01)
*A61G 1/003* (2006.01)

(52) U.S. Cl.
CPC ..... *A61G 1/0268* (2013.01); *A61G 7/1074* (2013.01); *A61G 1/003* (2013.01)

(58) Field of Classification Search
USPC ..... 5/509.1, 86.1, 503.1
See application file for complete search history.

(56) References Cited

U.S. PATENT DOCUMENTS 3,901,356 A 8/1975 Butler
4,037,871 A 7/1977 Bourgraf et al.
4,097,941 A 7/1978 Merkel
4,273,306 A 6/1981 Chang
4,549,720 A 10/1985 Bergenwall
4,691,962 A 9/1987 Holdt
4,962,941 A 10/1990 Rembos
4,987,620 A 1/1991 Sharon
5,438,723 A 8/1995 Carroll
5,479,666 A 1/1996 Foster et al.
5,537,700 A 7/1996 Way et al.
5,842,237 A 12/1998 Hargest et al.
6,125,485 A 10/2000 Way et al.
6,203,085 B1 * 3/2001 Ferris ..... A61G 1/0293 296/20
6,336,235 B1 1/2002 Ruehl
6,381,781 B1 5/2002 Bourgraf et al.
6,389,623 B1 5/2002 Flynn et al.
6,405,393 B2 6/2002 Megown
6,735,794 B1 5/2004 Way et al.
6,739,004 B1 5/2004 Abrahamsen et al.
6,792,633 B1 9/2004 Ito
6,799,770 B2 10/2004 Patrick et al.
6,920,656 B2 7/2005 Roussy
7,013,510 B1 3/2006 Johnson
7,131,151 B2 * 11/2006 Ferneau ..... A61G 1/0293 5/86.1
7,185,377 B2 3/2007 Roussy
7,520,347 B2 4/2009 Chambliss et al.
7,636,966 B2 12/2009 Gallant et al.
7,637,550 B2 12/2009 Menna
7,757,313 B2 7/2010 Koorey
8,117,696 B2 2/2012 Wernqvist et al.
8,381,330 B2 2/2013 Roussy
8,640,283 B2 2/2014 Broadley et al.
RE44,884 E 5/2014 Lambarth
8,739,329 B2 6/2014 Koorey
9,107,781 B1 8/2015 Edgerton
9,233,033 B2 1/2016 Valentino
9,351,584 B1 5/2016 Rizzardo et al.
9,579,240 B2 2/2017 Krolick et al.
2004/0187213 A1 9/2004 Wang
2005/0229312 A1 * 10/2005 Bishop ..... A61G 1/0293 5/620
2006/0016008 A1 1/2006 Choi et al.
2007/0000057 A1 * 1/2007 Ward ..... A61G 1/0293 5/611
2009/0172883 A1 * 7/2009 Benedict ..... A61G 1/0237 5/620
2010/0064439 A1 3/2010 Soltani
2010/0170041 A1 7/2010 Heimbrock et al.
2011/0260483 A1 * 10/2011 Chinn ..... A61G 1/0212 296/20
2012/0096644 A1 4/2012 Heimbrock
2012/0124746 A1 5/2012 Andrienko
2012/0292883 A1 11/2012 Noonan et al.
2014/0299391 A1 10/2014 Carletti
2015/0313780 A1 11/2015 Valentino et al.
2015/0320625 A1 11/2015 White
2015/0359693 A1 12/2015 Lyon
2016/0136021 A1 5/2016 Roussy et al.
2016/0287454 A1 10/2016 Magill et al.
2016/0374884 A1 12/2016 Blickensderfer et al.
2017/0042749 A1 2/2017 Valentino et al.
2017/0165135 A1 6/2017 Krolick et al.
2017/0165136 A1 6/2017 Krolick et al.
2017/0196740 A1 7/2017 Krolick et al.

FOREIGN PATENT DOCUMENTS

CN 201005885 Y 1/2008
EP 1226803 A1 7/2002
EP 2494889 A1 9/2012
GB 1046444 4/1962
GB 1084020 A 9/1967
WO 9705925 A1 2/1997
WO 9729726 8/1997
WO 9729726 A1 8/1997
WO 0239944 A2 5/2002
WO 02039944 A3 5/2002
WO 2008127089 A1 10/2008
WO 2009114806 A2 9/2009
WO 2011072023 A2 6/2011

* cited by examiner

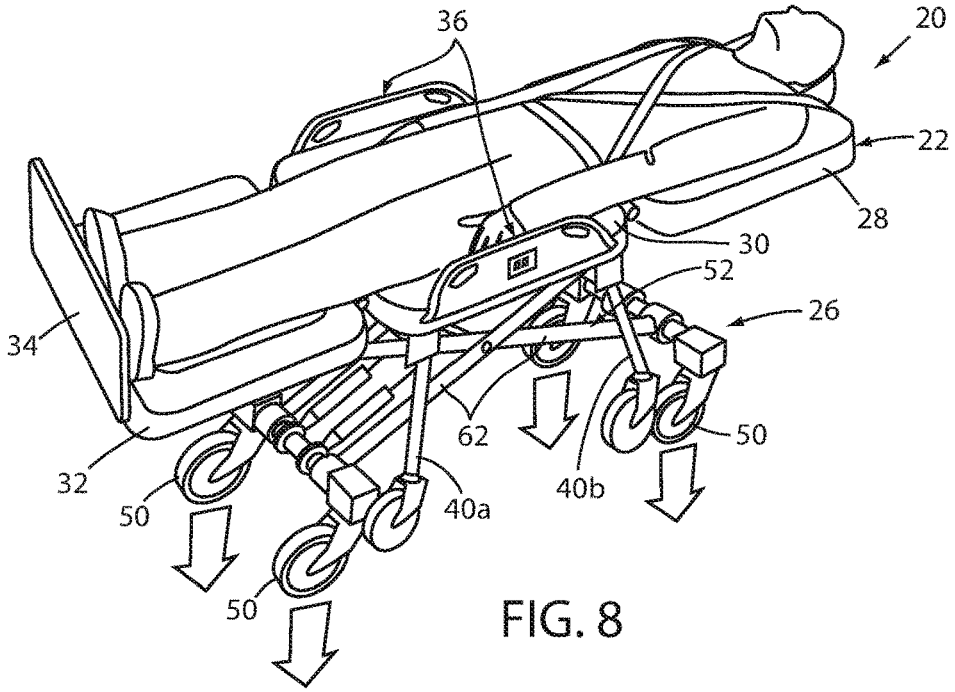
FIG. 8
FIG. 9
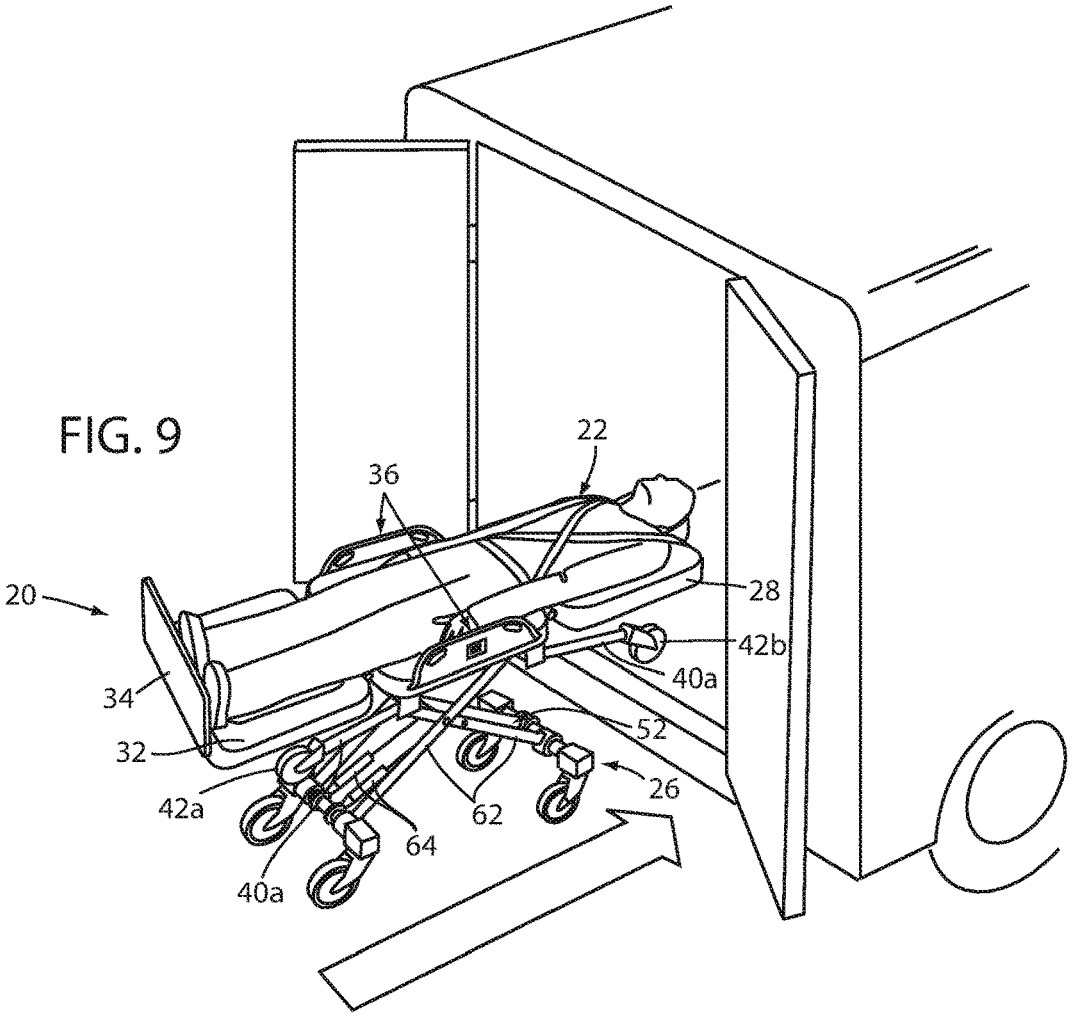

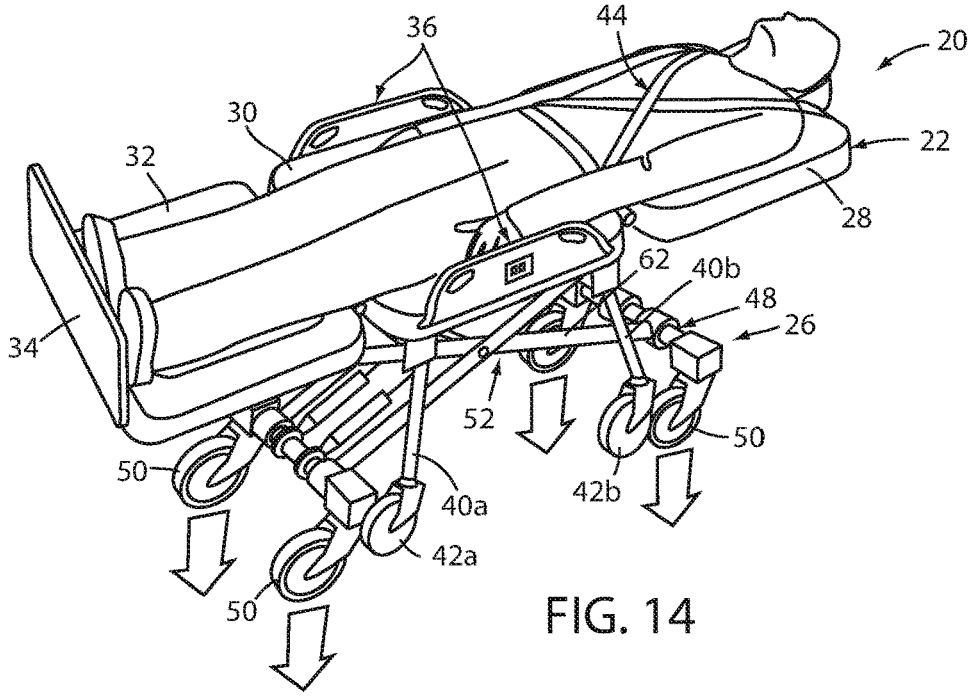
FIG. 14
FIG. 15
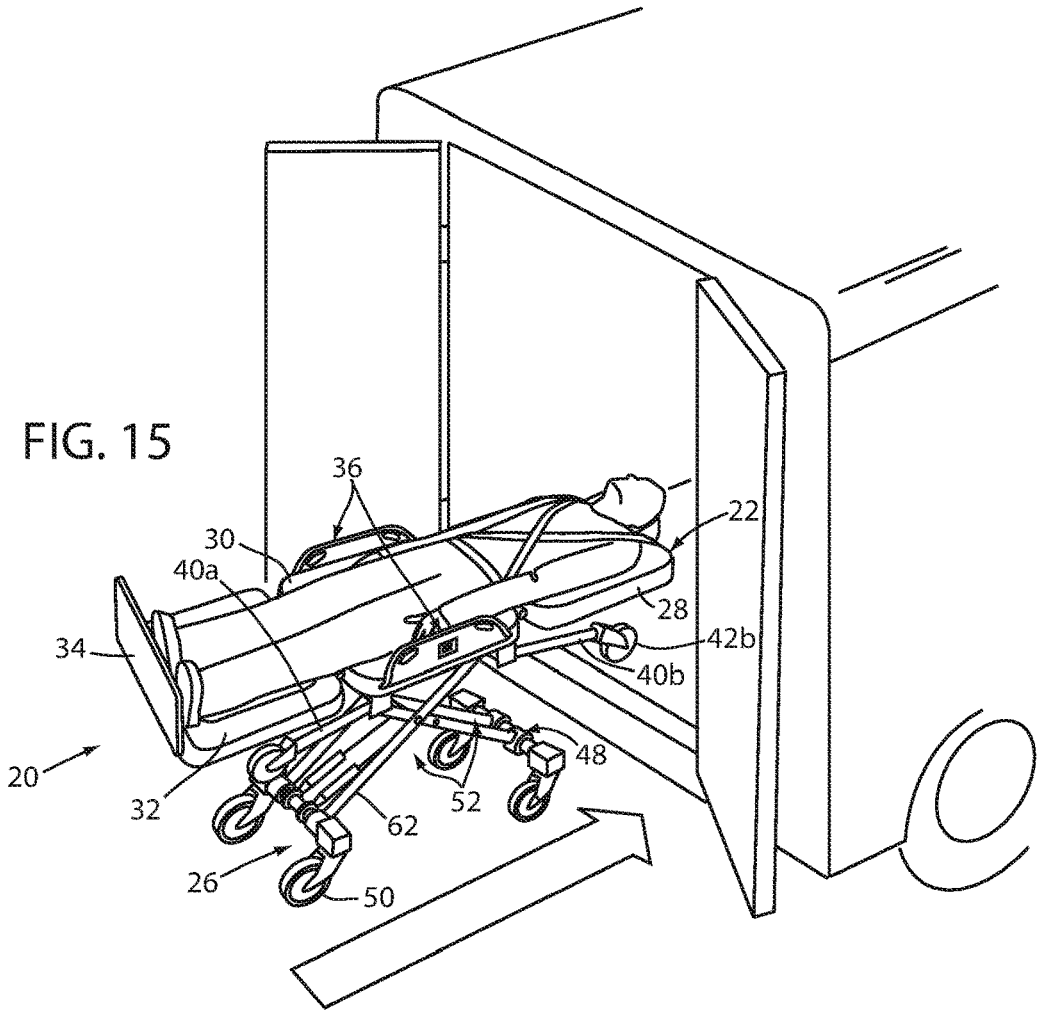

PERSON SUPPORT APPARATUS SYSTEM

The present application claims the benefit of provisional application 62/369,423, filed on Aug. 1, 2016, which is incorporated by reference herein in its entirety.

TECHNICAL FIELD AND BACKGROUND

The present disclosure relates to an emergency medical cot for transporting people, for example, when they have been injured.

A common challenge in the emergency medical service (EMS) industry is to reduce the stress and strain on EMS personnel when handling people who need assistance. For example, a common situation that can subject EMS personnel to undue stress, and possible injury, is when lifting a person up from the supporting floor or ground using a backboard. Typically, a person is first "log rolled" onto the backboard, and then the backboard is lifted and moved onto an emergency cot. Because the backboard is typically lying flat on the supporting floor or ground surface, it is particularly hard for EMS personnel to get into a proper lifting position.

Accordingly, there is a need to reduce the stress and strain on EMS personnel when handling a person who needs to be moved from a lying position on a supporting floor or ground surface to a cot.

SUMMARY

Accordingly, a person support apparatus system provides a person support apparatus that includes a deck with a primary lift to raise the deck off a supporting floor or ground surface to a first height and an auxiliary lift that can be positioned under the deck (after it is raised to the first height) and used to raise the deck to a greater height than the first height where the person support apparatus and auxiliary lift can then be loaded into an emergency vehicle.

In one embodiment, a person support apparatus includes a deck having a seat section, a leg section, and a back section, with the back section pivotally mounted to the seat section. The leg section has a proximal end pivotally mounted to the seat section and a distal, cantilevered end that is spaced a first distance from its proximal end. The seat section, the leg section, and the back section are arranged to lie in a common plane when the deck is in a supine configuration to support a person in a supine position. A lift is mounted to the seat section of the deck. The lift is configured to raise the deck relative to a supporting floor or ground surface to a maximum height less than the first distance.

In one aspect, the lift includes wheels.

In a further aspect, the lift comprises two pairs of legs. For example, each pair of legs may be pivotally mounted to the seat section of the deck for movement between a first orientation wherein the pair of legs is in a folded position and a second orientation wherein the pair of legs is in an unfolded position. Optionally, each leg includes a wheel.

In another aspect, each leg has a length less than the first distance. Optionally, the legs may be telescoping legs.

In other aspects, the lift includes at least one actuator for driving the legs of the lift between their folded positions and their unfolded positions. Optionally the actuator includes a motor and a gear. For example, a suitable gear may include a planetary gear or a cycloidal gear.

In yet other aspects, each pair of legs includes an actuator for driving it between folded and unfolded positions. Optionally, each actuator includes a motor and a gear.

In another aspect, each leg includes an actuator associated therewith to drive it between folded and unfolded positions. A suitable actuator includes a motor and a gear, such as a planetary or cycloidal gear.

In another embodiment, a person support apparatus includes a deck having a seat section, a leg section, and a back section. The back section and the leg section are each pivotally mounted to the seat section. A primary lift is mounted to the deck to raise the deck relative to a supporting floor or ground surface. A coupler is mounted to or an engagement structure is provided at the deck to releasably couple the deck to an auxiliary lift.

In one aspect, the coupler includes a quick release coupler. For example, the coupler may comprise a powered quick release coupler.

In another aspect, the coupler or the engagement structure includes a manually operable release or an electrically powered release.

In a further aspect, the coupler or the engagement structure includes a pair of couplers. For example, the pair of couplers may be mounted to the seat section of the deck or to the auxiliary lift.

In another aspect, the person support apparatus is combined with an auxiliary lift. The auxiliary lift is reconfigurable between a first configuration and a second configuration, with the first configuration having a first height, and the second configuration having a second height, wherein the second height is greater than the first height.

In one aspect, the auxiliary lift includes a pair of X-frames.

In one aspect, the primary lift is configured to raise the deck relative to a supporting floor or ground surface to a height greater than the first height of the auxiliary lift to allow the auxiliary lift to be positioned under the deck when the auxiliary lift is in its first configuration.

In another aspect, the primary lift includes one or more wheels. Further, the primary lift is configured to form a space between the wheels to receive the auxiliary lift. In this manner, the deck may be moved over the auxiliary lift between the wheels of the primary lift when the deck is raised to a height equal to or greater than the height of the auxiliary lift.

In yet another aspect, the auxiliary lift includes one or more sets of wheels. The primary lift forms a space there between, which is sized to receive the auxiliary lift when the auxiliary lift is in its first configuration. The auxiliary lift may be moved under the deck into the space of the primary lift when the deck is raised to a height equal to or greater than the auxiliary lift.

According to yet another aspect, the primary lift includes two pairs of legs. Each pair of legs is pivotally mounted to the seat section of the deck for movement between a first orientation wherein the legs are in a folded position and a second orientation wherein the legs are in an unfolded position.

In one aspect, each leg includes a wheel.

In another aspect, each pair of legs of the primary lift has a length less than the length of the seat section. Optionally, the legs of the primary lift may comprise telescoping legs.

In another aspect, the auxiliary lift includes an engagement structure or a coupler to be engaged by a corresponding coupler or engage a corresponding engagement structure on the deck.

According to yet another aspect, the auxiliary lift includes a base and a plurality of caster wheels mounted to the base. Each caster wheel is rotatably mounted to the base about a horizontal axis wherein the caster wheels may be moved between (1) non-operative positions wherein the caster wheels are positioned for disengagement from the supporting floor or ground surface and (2) operative positions wherein the caster wheels are positioned for engagement with the supporting floor or ground surface.

In any of the above, the person support apparatus may include side rails mounted to the seat section.

In one aspect, each side rail is pivotally mounted to the seat section and movable between a raised position and a lowered position.

In another aspect, the leg section and the back section are pivotal into a seat configuration wherein the back section is generally upright with respect to the seat section, and the leg section is angled generally downwardly with respect to the seat section. Optionally, the leg section may be orthogonal to the seat section to form a full chair position so as to facilitate egress or ingress onto the deck when the deck is in a full chair position.

In one aspect, the deck includes a foot section.

According to any of the above apparatuses, the deck may have raised sides to form a trough-shape deck.

According to yet another embodiment, a person support apparatus system includes a deck, a primary lift mounted to the deck to raise the deck relative to a supporting floor or ground surface, and an auxiliary lift. The auxiliary lift is selectively positionable under the deck. A coupler is mounted to (1) the deck or (2) the auxiliary lift, and an engagement structure is formed or mounted to the other of (1) the deck or (2) the auxiliary lift deck to cooperate with the coupler to releasably couple the deck to the auxiliary lift when the auxiliary lift is positioned under the deck.

In one aspect, the auxiliary lift is reconfigurable between a first configuration and a second configuration, with the first configuration having a first height, the second configuration having a second height, and the second height being greater than the first height. The auxiliary lift is selectively positionable under the deck when in its first configuration and the deck is raised.

In another aspect, the primary lift is operable to raise the deck relative to a supporting floor surface to a minimum height greater than the first height of the auxiliary lift when the auxiliary lift is in its first configuration to allow the auxiliary lift to be positioned under the deck when the deck is moved to the minimum height.

In yet another aspect, the primary lift includes one or more wheels wherein the deck may be moved over the auxiliary lift when the deck is raised to a height equal to or greater than the minimum height and when the auxiliary lift is in the first configuration.

In yet another aspect, the primary lift includes legs. Each leg is pivotally mounted to the deck for movement between (1) a first orientation wherein the leg is in a folded position and (2) a second orientation wherein the leg is in an unfolded position. Further, each leg has a driver associated therewith to move the leg between its first orientation and its second orientation.

According to other aspect, the auxiliary lift includes a base and a pair of X-frames mounted to the base. The X-frames are configured to collapse into the base when the auxiliary lift is in the first configuration.

In a further aspect, the auxiliary lift further includes caster wheels. Each caster wheel is mounted to move between an operative position to engage a supporting floor or ground surface and a non-operative position to disengage from the supporting floor or ground surface.

In one aspect, the caster wheels move between their non-operative positions to their operative positions under the force of gravity.

According to yet another aspect, the deck includes one or more depending members to urge the caster wheels to move between their operative positions to their non-operative positions.

In yet another aspect, the deck includes one or more couplers to move the caster wheels to move between their operative positions to their non-operative positions.

These and other advantages and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE DRAWINGS

FIG. 8 is a perspective view of the patient support apparatus system with the auxiliary lift raising the person support apparatus above a supporting floor or ground surface;

FIG. 9 is a similar view to FIG. 8 illustrating the legs of the primary lift being repositioned for inserting the person support apparatus system into the compartment of an emergency vehicle;

FIG. 14 is a similar view to FIG. 13 with the auxiliary lift configured in a raised position to lift the patient support apparatus off the supporting floor or ground surface;

FIG. 15 is a similar view to FIG. 9 showing the patient support apparatus system being moved towards the rear opening of the emergency vehicle compartment with the legs of the primary lift moved to a loading position;

DESCRIPTION

Figure 1:
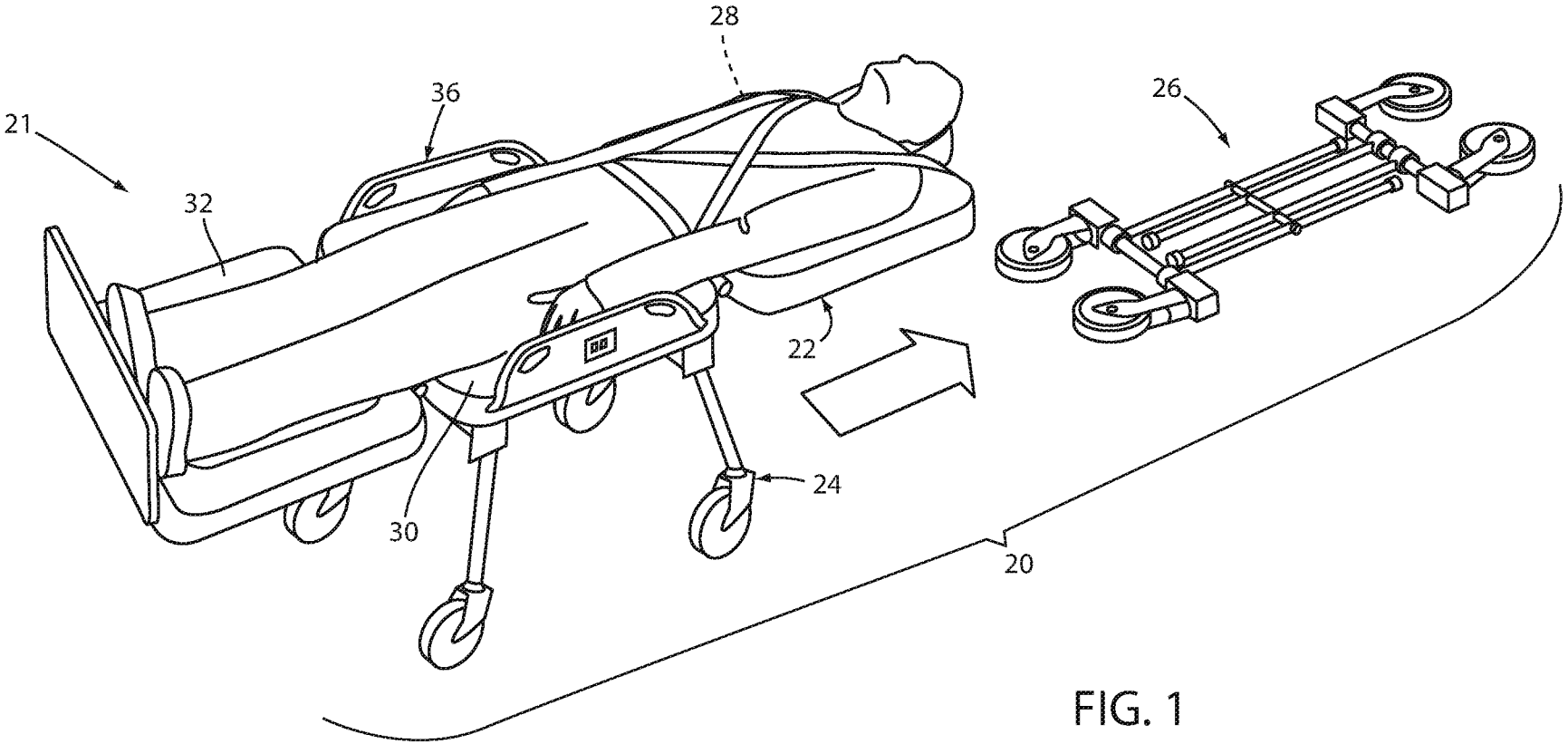
FIG. 1 is a perspective view of a person support apparatus shown in supine configuration in a fully lowered position.

Referring to FIG. 1, the numeral 20 generally designates a person support apparatus system. As will be more fully described below, person support apparatus system 20 includes a person support apparatus 21 that may be configured so that it can take the place of a backboard and allow an EMS person to transfer a person onto person support apparatus system 20 without having to lift the whole weight of the person. Further, person support apparatus 21 can be reconfigured into several configurations, such as a cot configuration or a chair configuration. In addition, as will be more fully described below, person support apparatus 21 includes a deck 22 and a primary lift 24 to raise deck 22 between a fully lowered position and a first maximum height, and an auxiliary lift 26 to raise deck 22 to a second height greater than the first maximum height, for example, to a cot height. The term "primary" is not meant to imply that it is the most important or principal lift, but instead it is the first lift used when raising the deck off a supporting floor or ground surface.

Figure 2:
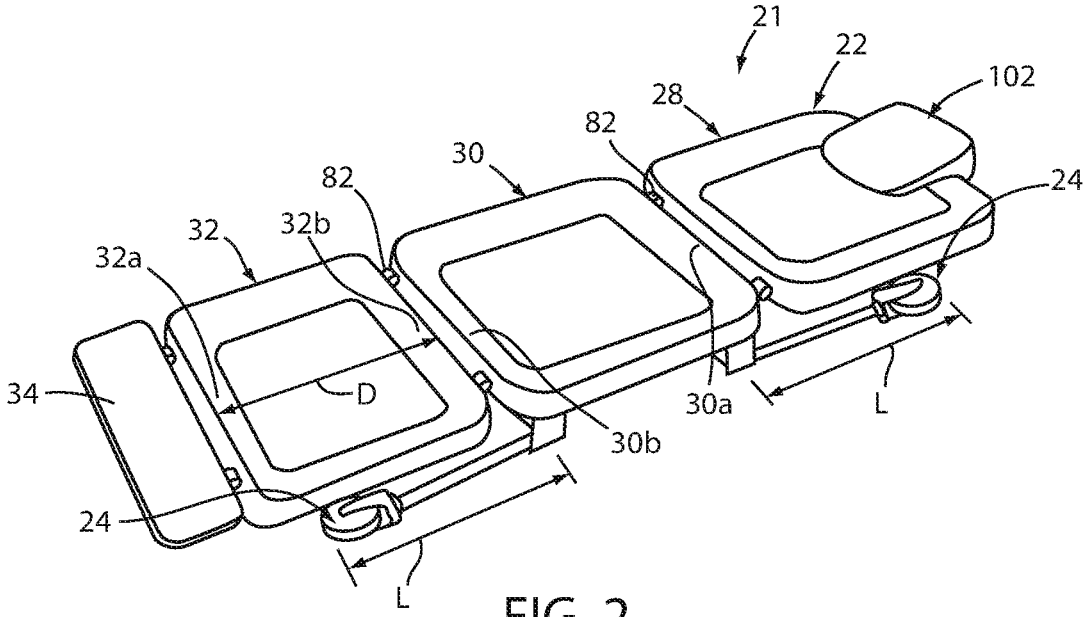
FIG. 2 is a perspective view of the person support apparatus of FIG. 1 shown in the supine configuration in a raised position.

As best seen in FIG. 2, deck 22 comprises an articulatable deck with a back section 28, a seat section 30, and a leg section 32, with the back section 28 and leg section 32 pivotally mounted to opposed ends 30*a* and 30*b* of seat section 30. Alternately, deck 22 may comprise a rigid deck, like a backboard. Though, when configured as a backboard, some of the functionalities described below will be eliminated.

Further, in addition to back section 28, seat section 30, and leg section 32, deck 22 optionally includes a foot section 34. In one embodiment, foot section 34 is mounted to the distal cantilevered end 32*a* of leg section 32, whereas the proximal end 32*b* of leg section 32 is pivotally mounted to proximal end 30*b* of seat section 30.

Figure 3:
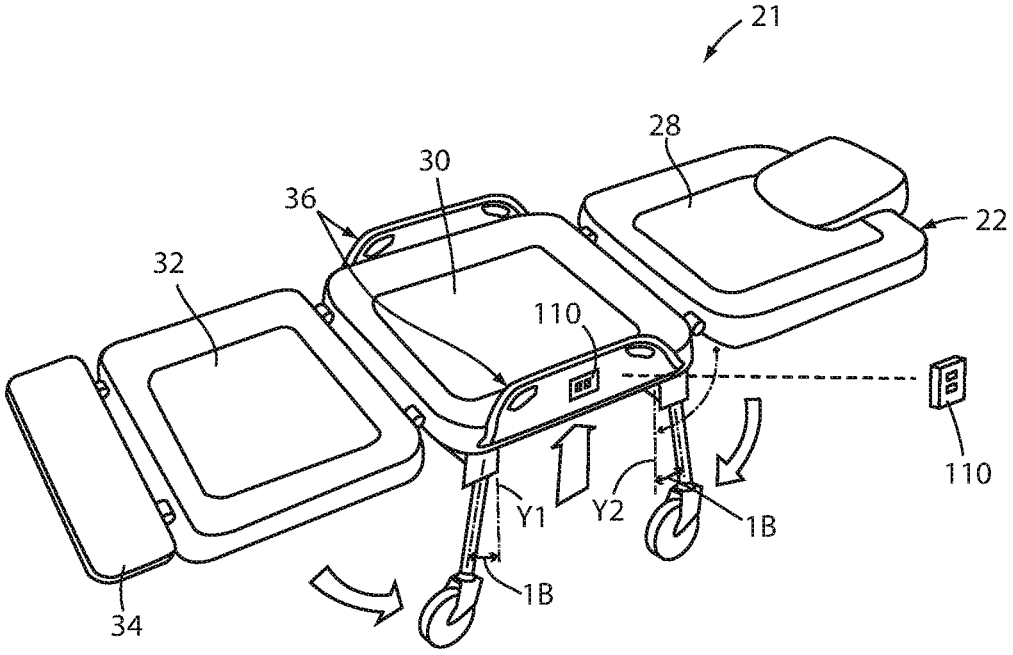
FIG. 3 is a perspective view of the person support apparatus of FIG. 1 shown in a chair configuration.

Additionally, referring to FIG. 3, deck 22 optionally includes side rails 36. In one embodiment, side rails 36 are mounted to seat section 30, and optionally pivotally mounted to seat section 30. For example, in one embodiment, each side rail 36 is pivotally mounted to seat section 30 in a plane that is parallel to the side of seat section 30. For example, the side rails 36 may have a four bar linkage system, such as disclosed in U.S. Pat. No. 7,412,734, issued on Aug. 19, 2008, entitled BED SIDERAIL (STR03B P-122A), commonly owned by Stryker Corporation of Kalamazoo, Mich., the complete disclosure of which is hereby incorporated herein by reference.

In another embodiment, each side rail 36 is pivotally mounted about an axis parallel to the side of the seat section 30 so that they can be lowered to widen seat section and thereby provide extensions of seat section 30, as will be more fully described below in reference to FIG. 11. For an example of a suitable side rail, reference is made to U.S. patent application Ser. No. 29/546,441, filed on Nov. 23, 2015 by applicants Clifford Edwin Lambarth et al., and entitled EMERGENCY COT AND SIDE RAILS (STR03A P-346A), commonly owned by Stryker Corporation of Kalamazoo, Mich., which is incorporated by reference in its entirety herein.

Referring again to FIG. 2, back section 28, seat section 30, and leg section 32 are pivotally joined together, as noted, and are arranged so that they can generally lie in a common plane so that deck 22 can be used in place of a backboard. Optionally, to provide added stability to a person lying on deck 22, deck 22 may be configured to have a generally trough-shaped cross-section to cradle a person lying on deck 22. Optionally, this trough-shaped cross-section may be formed by the sections (28, 30, and/or 32) themselves, by the side rails 36 when extended outwardly, as noted above, or a combination of both, or by pads that are mounted to the deck sections.

In use, when deck 22 is fully lowered or at least nearly fully lowered, deck 22 may be positioned alongside a person. After the person is rolled upwardly, away from deck 22, deck 22 can then be moved (e.g. by sliding) closer to the person and then also tilted up about the edge closest to the person so that the person can then be leaned against the deck 22. Thereafter, the person and deck 22 can be lowered together onto the supporting floor or ground surface. This is referred to as "log rolling". Once lowered back on to the supporting floor or ground surface, deck 22 (and the person) can then be raised relative to the supporting floor or ground surface by primary lift 24.

Figure 4:
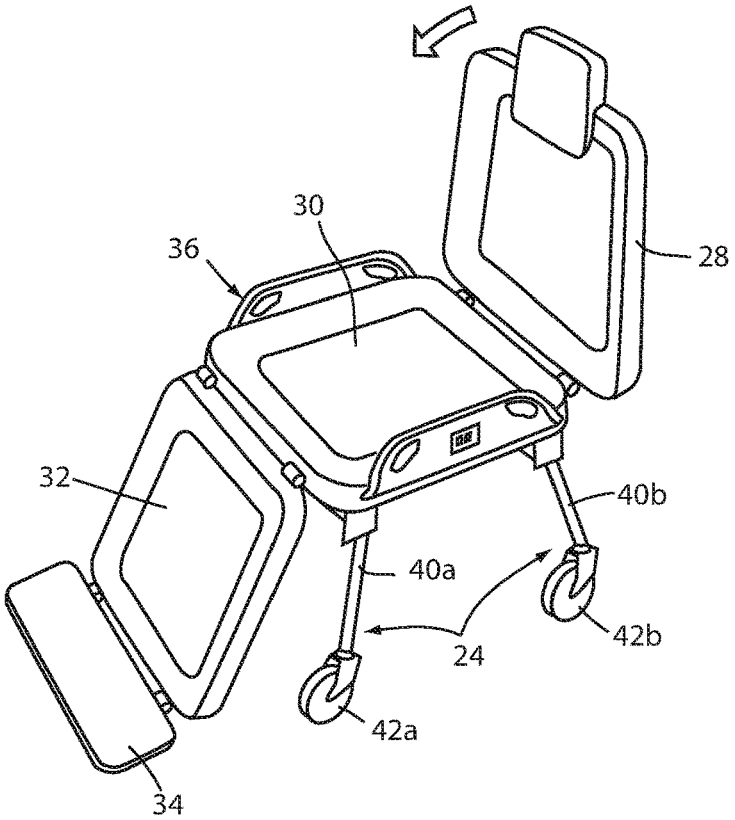
FIG. 4 is a similar view to FIG. 3 illustrating a person secured in the person support apparatus.
Figure 4A:
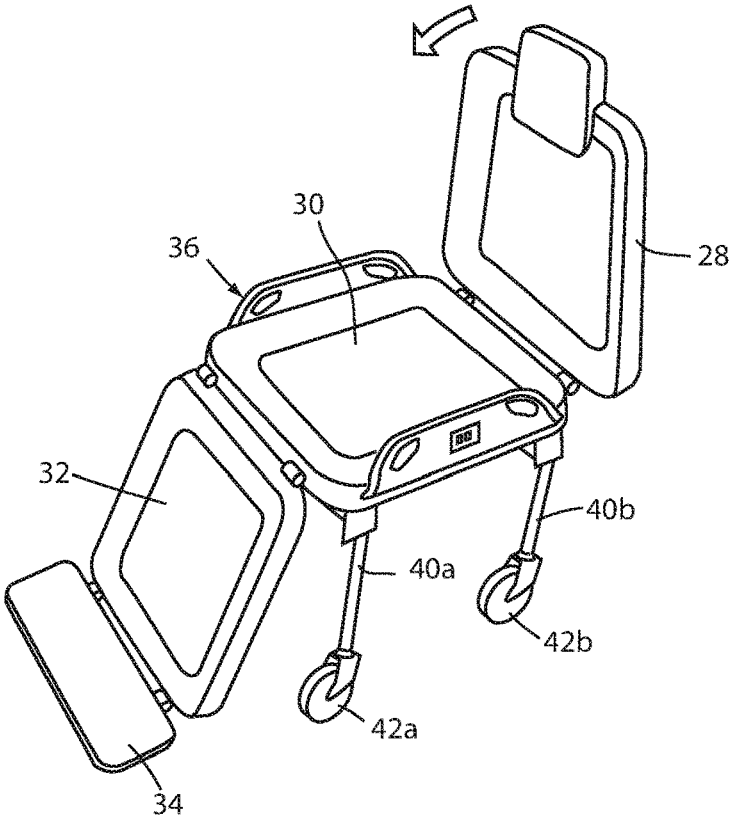
FIG. 4A is similar view to FIG. 4 illustrating the person support apparatus in a chair configuration but with the head end legs moved to another position than shown in FIG. 4.
Figure 5:
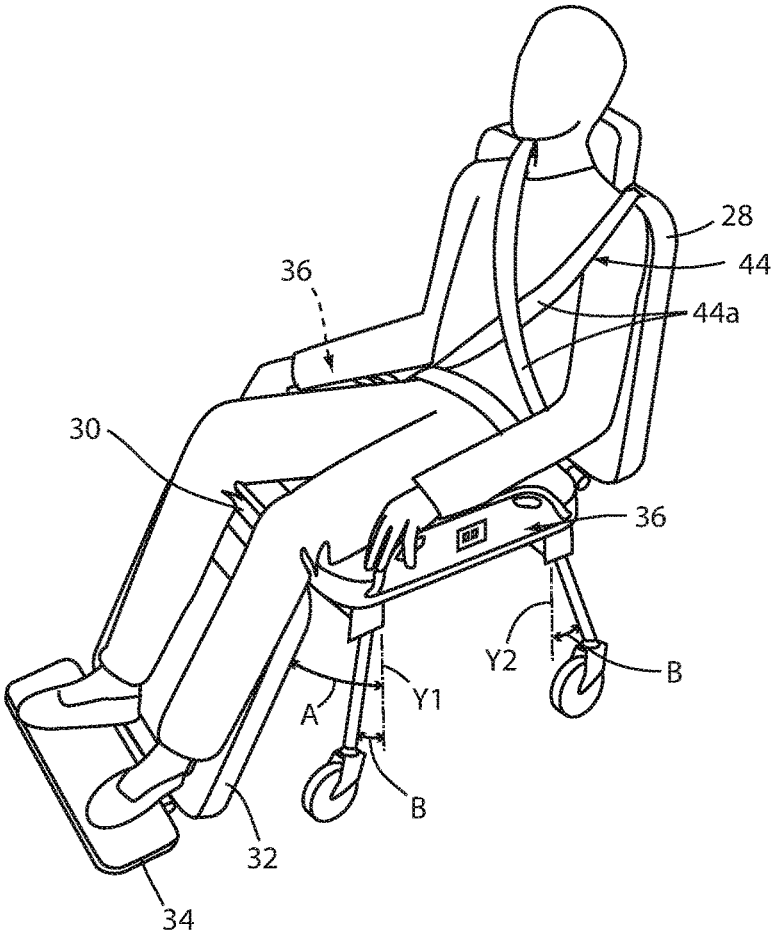
FIG. 5 is a perspective view of the person support apparatus FIG. 2 shown being wheeled toward an auxiliary lift.

Optionally, primary lift 24 is configured to raise deck 22 to a height where the deck sections 28, 30, and 32 can be reconfigured into a chair configuration, such as shown in FIGS. 4, 4A, and 5. In addition or alternately, deck 22 may be raised to a height where deck 22 is only sufficiently raised above the supporting floor surface so that auxiliary lift 26 may be selectively positioned under deck 22, either by moving the auxiliary lift 26 under the deck or moving the deck 22 over lift 26. Once properly aligned under deck 22, lift 26 is then engaged with deck 22 to form person support apparatus system 20—which can be used as an EMS cot, as will be more fully described below.

Referring again to FIGS. 3-5, primary lift 24 may include two pairs of legs, namely head-end legs 40*a* and foot-end legs 40*b*. The reference to "head-end" simply refers to the fact that the head-end legs are closer to the head end 22*a* of deck 22 than the foot-end legs 40*b*, and does not require the head-end legs to be under the head of a person lying on deck 22. Similarly, the reference to "foot-end" simply refers to the fact that the foot-end legs are closer to the foot end 22*b* of deck 22 than head-end legs 40*a*, and does not require the foot-end legs to be under the feet of a person lying on deck 22. Further, each leg 40*a*, 40*b* includes a wheel 42*a* and 42*b* to facilitate movement of the deck 22 across the supporting floor or ground surface.

Legs 40*a*, 40*b* are optionally sized so that their length L (FIG. 2) or their effective supporting height L1 (FIG. 3) is shorter than the length D (FIG. 2) of leg section 32 of deck 22. In this manner, when legs 40*a*, 40*b* are moved to a chair position, e.g. fully downwardly and in their fully extended position, leg section 32 of deck 22 may be lowered and angled downwardly to a chair configuration, but not to a full chair orientation (i.e., perpendicular to the supporting floor or ground surface); otherwise leg section 32 will make contact with the supporting floor. In other words, in one embodiment when apparatus 21 is in a chair configuration, leg section 32 can only be lowered to angle A (FIG. 5) with respect to vertical of greater than zero so as not to create an interference with the supporting floor. In another embodiment, the length of the legs may be increased (either by providing longer legs or longer telescoping legs) so that the leg section of the deck may be fully lowered where it is perpendicular to the supporting floor without interference from the supporting floor.

Optionally, as noted, when in their fully deployed positions, legs 40*a*, 40*b* may be perpendicular relative to the supporting floor or angled at an acute angle B (FIGS. 3 and 5) with respect to respective vertical axes Y1 and Y2, for example, in a range of 0° to 30°, or in a range of 10° to 20° (FIG. 5). It should be understood that the head end legs and the foot end legs may be oriented so they are parallel or near parallel legs or angled (diverging (FIG. 4) or converging (as shown in FIG. 4A)), provided that apparatus 21 is stable. Consequently, as noted and referring to FIG. 2, the length L (the length of the leg including the wheel when the legs are perpendicular) or the effective length or supporting height L1 (FIG. 3) (when the legs are angled) of each leg 40*a*, 40*b* is optionally less than the distance D (FIG. 2) from the proximal end 32*b* of leg section 32 to the distal, cantilevered end 32*a* of leg section 32. Alternately, the length L or the effective supporting height L1 of legs 40*a*, 40*b* may be equal or greater than D so that leg section 32 of deck 22 may be deployed to a full chair configuration (moved to an orthogonal orientation relative to the supporting floor surface and seat section 30) when the legs are moved to their chair position. Further, the legs may be initially shorter but comprise telescoping legs to adjust the height of the deck, for example, once it is initially raised off the supporting floor or ground surface.

Figure 16:
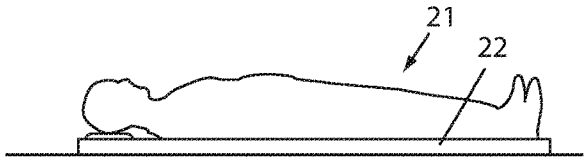
FIG. 16 is a side elevation view of the person support apparatus in a fully lowered position.

In addition, as shown in FIG. 16, deck 22 may be configured so that legs 40*a* and 40*b* may be folded up into deck 22 so that when legs 40*a* and 40*b* are moved to their folded position, the deck 22 may lie on the ground or supporting floor surface to further reduce the height profile of apparatus 20. This may be achieved by forming recesses in the respective deck sections (e.g. head and foot sections) or by the configuration of the members forming the deck, i.e. by forming the deck sections by or with inverted channel shaped members or frames. Further, deck 22 may be configured to couple to a separate backboard, such as described in copending U.S. Prov. Pat. Appl. entitled EMS BACKBOARD, filed by Stryker Corporation on Aug. 1, 2016, which is hereby incorporated by reference in its entirety.

Figure 11:
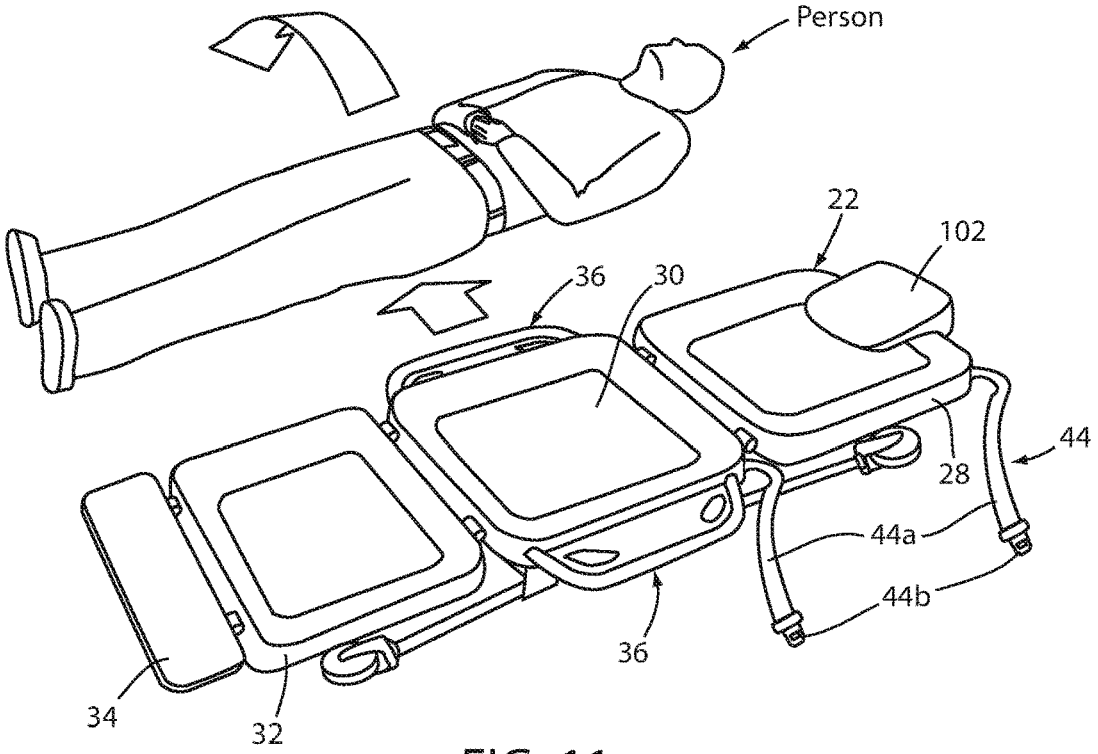
FIG. 11 is a perspective view of the patient support apparatus illustrating a person being log rolled onto the person support apparatus in its lowered configuration.
Figure 12:
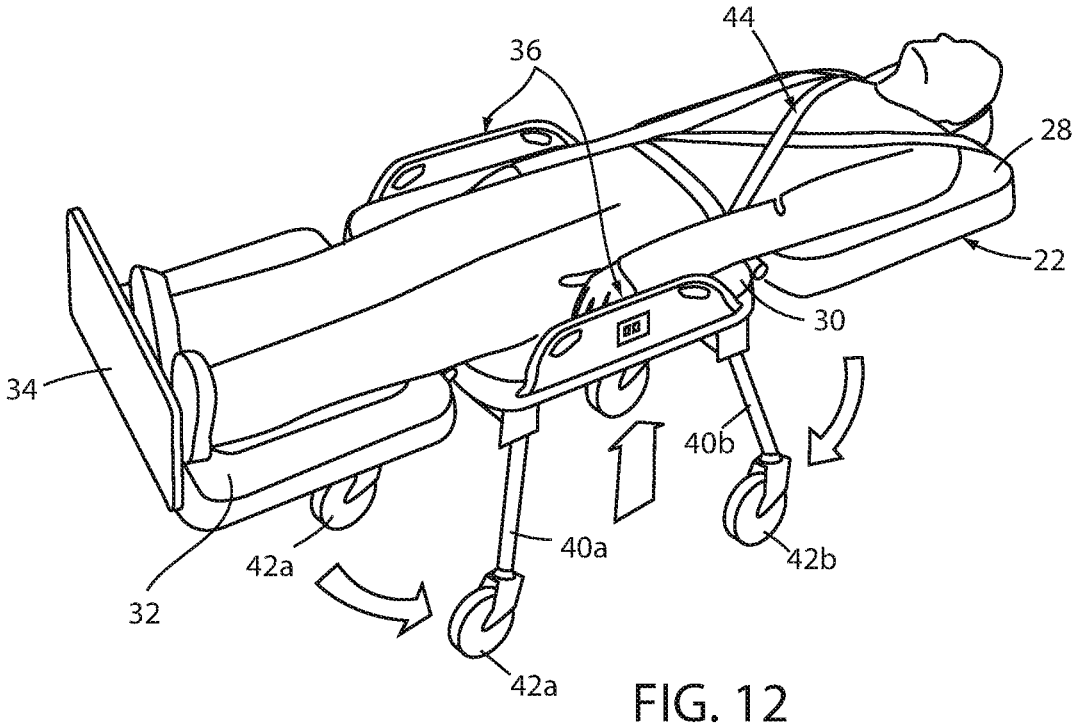
FIG. 12 is another perspective view of the patient support apparatus of FIG. 11 illustrating the person secured to the patient support apparatus and the patient support apparatus raised by the legs of the primary lift moved to their operative positions.

As noted above, to facilitate retaining a person on deck 22, deck 22 optionally includes one or more restraints 44 (FIG. 11). For example, restraints 44 may comprise straps 44*a* anchored to the head-end corners of back section 28. To secure the straps 44*a* across a person lying on deck 22, each strap 44*a* may include a tab or buckle 44*b* (FIG. 11) for engaging buckles or tabs mounted to the deck, for example to the opposed corners on the opposed end of back section 28 or to the opposed corners on the head end side of seat section 30, so that straps 44*a* may cross over the torso of a patient lying on deck 22, such as shown in FIGS. 1 and 14, and then be secured and tightened in place. Alternately, the straps 44*a* may include the tabs, with the buckles mounted to the deck.

Figure 13:
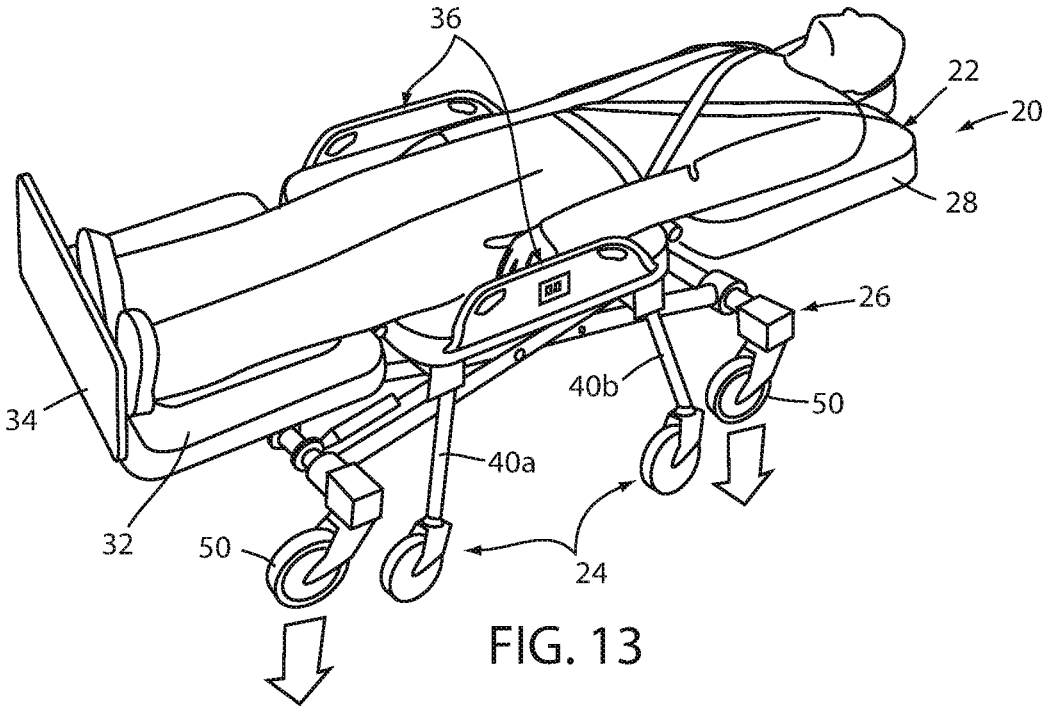
FIG. 13 is another perspective view of the person support apparatus illustrating the auxiliary lift located beneath the patient support apparatus, which is lowered onto the auxiliary lift for engagement therewith.
Figure 18:
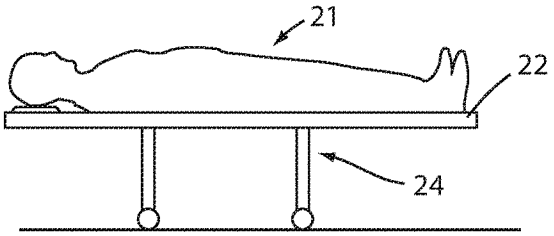
FIG. 18 is a side elevation view of the person support apparatus with the primary lift in a fully raised position.
Figure 17:
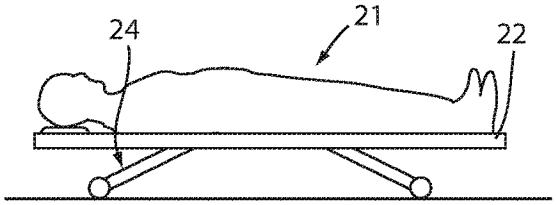
FIG. 17 is a side elevation view of the person support apparatus with the primary lift in a partially lowered position.

Referring again to FIGS. 1 and 13, auxiliary lift 26 is configured so that it can be folded or collapsed into a low profile so that it can be moved under deck 22 or so that deck 22 can be moved over lift 26, for example, when deck 22 is raised by primary lift 24. For example, lift 26 may have a minimum height (as measured from a supporting floor surface) in a range of 3 inches to 10 inches, optionally 4 inches to 9 inches, and optionally approximately 5 to 8 inches. As noted above, in order to achieve the low profile, lift 26 is configured to fold or collapse.

Figure 5A:
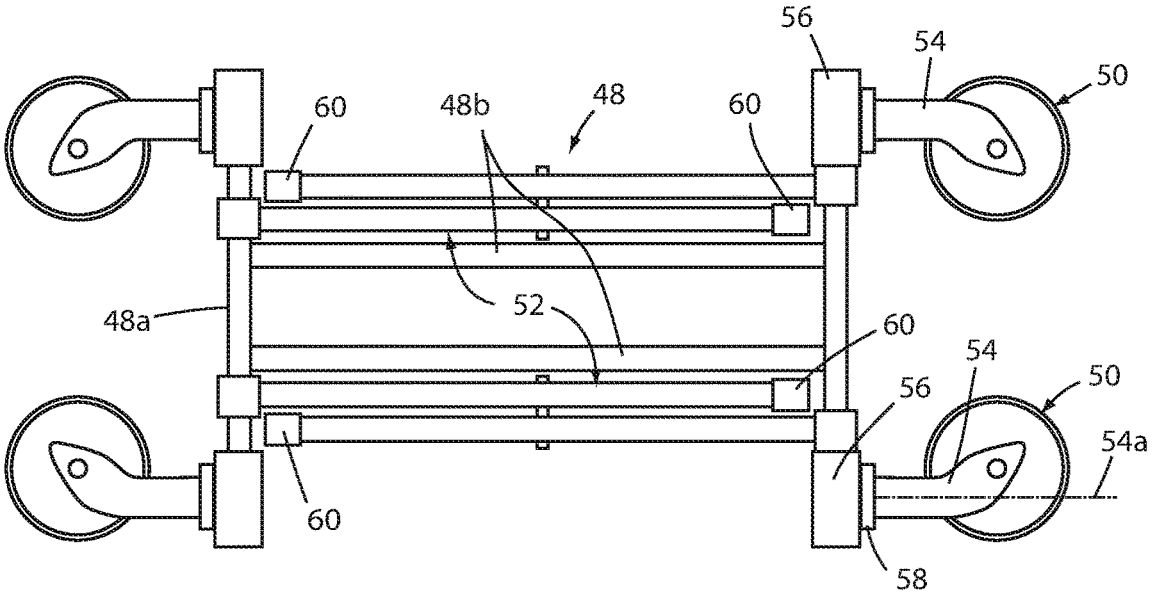
FIG. 5A is an enlarged perspective view of the auxiliary lift shown in its lowered, compact configuration.
Figure 6:
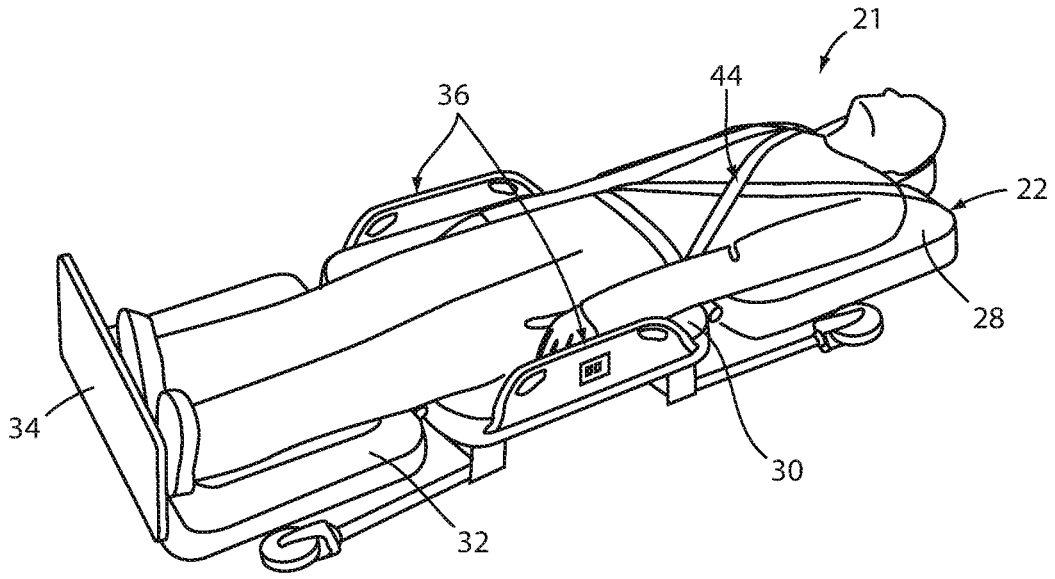
FIG. 6 is a perspective view of the person support apparatus illustrating a person secured to the person support apparatus and with the foot section tilted upwardly.
Figure 7:
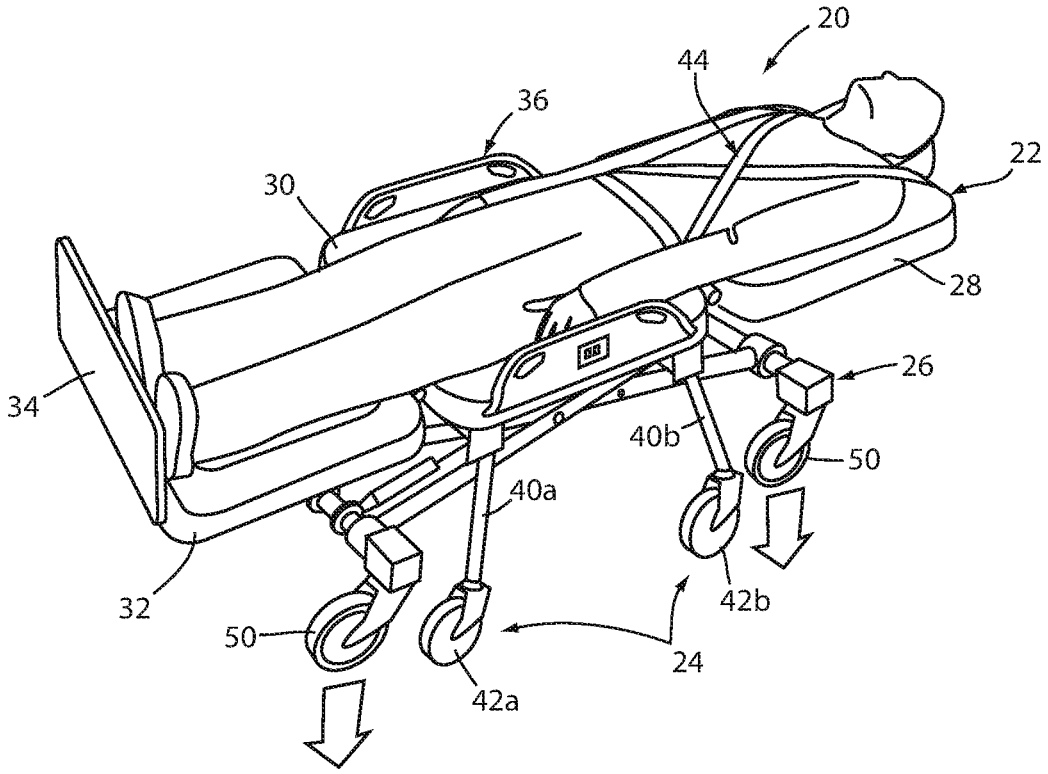
FIG. 7 is a similar view to FIG. 6 with the person support apparatus raised to allow the auxiliary lift to be the position under the person support apparatus to form a patient support apparatus system.

Referring to FIG. 5A, lift 26 includes a base 48 that supports a plurality of caster wheels 50 and a pair of X-frames 52. Optionally, X-frames 52 are pivotally mounted about the lower ends to base 48 in a manner so that when X-frames 52 are folded, they generally lie in the same plane as base 48. Similarly, caster wheels 50 are mounted to base 48 so that they can pivot about base 48 to move between a deployed or operative position where caster wheels 50 can engage a supporting floor surface (FIG. 14) or a folded or non-operative position (FIGS. 1, 5A, and 10), wherein the wheels 50 no longer engage the supporting floor or ground surface. Optionally, when in their non-operative positions, wheels 50 generally lie in the same plane as base 48, as well. In this manner, when the X-frames 52 are folded to their compact configuration and wheels 50 are folded, the height of lift 26 (defined between the lowermost surfaces of the base, the wheels, or the X-frames and the uppermost surface of the frame, the wheels, or the X-frames) may be reduced to provide a compact lift mechanism, which allows the deck 22 to achieve a low height even when lift assembly 26 is positioned under deck 22.

In the illustrated embodiment, base 48 includes transverse frame members 48*a* and optionally cross-frame members 48*b* (FIG. 5A) that are mounted to or formed with transverse frame members 48*a* to thereby form a frame and maintain transverse frame members 48*a* in a fixed relationship. X-frames 52 are then mounted at their lower ends to transverse frame members 48*a*. Further, cross-frame members 48*b* may be located between X-frames as shown in FIG. 5A or may be located along the outer sides of base 48 outside X-frames 52. Additionally, it should be understood that cross-frame members 48*b* may be omitted (e.g. see FIGS. 7-10), with the spacing of transverse frame members 48*a* maintained in a fixed spaced relationship instead by the actuators that control the extension or contraction of X-frames 52.

Referring again to FIG. 5A, each caster wheel 50 may be rotatably mounted to a yoke 54, which is then journaled in a mount 56. Mounts 56 are mounted to base 48, and specifically to transverse frame members 48*a*. Optionally, each yoke 54 is mounted in a bushing 58 in mount 56 and is free to rotate in mount 56 about an axis of rotation 54*a* between its respective operative and non-operative positions. Further, wheels 50 are mounted offset from the central axis of their respective yokes; therefore, wheels 50 optionally can rotate downward under the force of gravity from their non-operative positions to their operative positions once base 48 is lifted from the supporting floor or ground surface by deck 22, as more fully described below. Wheels (e.g. wheels 42*a*, 42*b*) mounted to legs 40*a* and 40*b* may also be mounted in a similar manner to wheels 50 so that they too can fold when legs 40*a* and 40*b* are moved to their stowed positions and then unfold when legs 40*a* and 40*b* are deployed to their operative positions. Further, wheels 42*a*, 42*b* may comprise caster wheel assemblies that are mounted to legs 40*a*, 40*b* with yokes and vertical pivot shafts or pins that are configured so that their swivel axes are maintained in a vertical orientation regardless of the orientation of the respective leg. For examples of suitable mounting arrangements reference is made to co-pending provisional application entitled MULTI-FUNCTION PERSON HANDLING EQUIPMENT, filed by Stryker Corporation on Aug. 1, 2016, which is incorporated by reference herein in its entirety.

In one embodiment, deck 22 may include releasable couplers, such as formed by c-shaped clamps or magnets, such as electromagnets, or the like, that couple to the wheels 50, for example, to the yokes 54 of the respective wheels to hold them in their non-operative positions until they are decoupled from the wheels. For example, when deck 22 is lowered and engaged with lift 26 (as more fully described below), and driver 64 is actuated to raise X-frame members, the relative motion will cause the releasable couplers to disengage from the wheels to allow them to move to their deployed positions, for example, under the force of gravity. The couplers may be mounted to deck 22 on depending members that are mounted or directly to the deck section frame members.

Alternately, each wheel 50 may include a driver to move them between their non-operative positions and to their operative positions. Suitable drivers include manual or powered drivers, such as solenoids, actuators, including pneumatic, hydraulic, or electric actuators, or magnets, such as electromagnets that can be turned on or off to control the motion of the wheel.

In addition, similar to wheels 42*a*, 42*b*, wheels 50 may be mounted to base 48 with yokes and vertical pivot shafts or pins that are configured so that their swivel axes are maintained in a vertical orientation regardless of the orientation of the base, e.g. in the case of a folding base 48. For examples of suitable mounting arrangements reference is made to provisional application Ser. No. 62/369,417 filed on Aug. 1, 2016 entitled MULTI-FUNCTION PERSON HANDLING EQUIPMENT and U.S. application Ser. No. 15/664,610 filed Jul. 31, 2017 entitled MULTI-FUNCTIONAL PERSON HANDLING EQUIPMENT, filed by Stryker Corporation, which are incorporated by reference herein in their entireties.

As noted above, lift 26 is configured for raising deck 22 after it is positioned under deck 22 and between legs 40*a*, 40*b*. Before raising deck 22, lift 26 is coupled to deck 22. In order to couple lift 26 to deck 22, deck 22 and/or lift 26 include couplers 60 (FIG. 5A) that couple X-frames 52 to deck 22. In one embodiment, couplers 60 are mounted to the upper free ends 62*a* of X-frame members 62 of X-frames 52, which engage deck 22, for example, at seat section 30. Couplers 60 may be mounted to the ends of the X-frames 52 to engage structures provided on seat section 30 or may simply engage the frame members of seat section 30, more fully described below. For example, couplers 60 may comprise quick release couplers, including powered quick release structures, or may be powered couplers that engage and disengage only when powered. Suitable couplers include over-center spring biased latches, such as described in U.S. Pro. Pat. App. Ser. No. 62/245,563 entitled Cot Fastening System (P486), commonly owned by Stryker Corporation of Kalamazoo, Mich., which is incorporated by reference in its entirety herein.

To bring couplers 60 into engagement with deck 22, either deck 22 is lowered onto lift 26 or the X-frame members 62 of lift 26 are raised (after lift 26 is properly aligned under deck 22). To raise the X-frame members 62 of lift 26, lift 26 includes one or more drivers 64 (FIG. 9). Drivers 64 may comprise a motor and gear or an actuator, such as a pneumatic, hydraulic or electric actuator, including a linear or rotary actuator. For example, in one embodiment, one end of the driver 64 is pinned to base 48, while the other end of the driver 64 is pinned to a respective X-frame member 62. In the illustrated embodiment, each X-frame member 62 is a telescoping X-frame member 62 to facilitate better control over the raising and lower of deck, e.g. to maintaining the deck level when raising or lowering the deck (e.g. when in its flat configuration), and avoid binding. For examples of a suitable X-frame and driver arrangement, reference is made to U.S. RE 44,884, which is incorporated by reference herein in its entirety.

Once lift 26 is engaged with deck 22, lift 26 may be used to raise deck 22 to a desired height, such as a cot height (such as shown in FIGS. 8, 9, 14, and 15), including at a height for loading deck 22 and lift 26 into a compartment of an emergency vehicle (such as shown in FIGS. 9 and 15).

Further, optionally, once deck 22 is raised by lift 26, such as shown FIGS. 14-15, legs 40*a* may be pivoted to a stowed position alongside deck 22, and legs 40*b* may be pivoted to a loading position (FIG. 15) so that they can be used to assist with the loading of the deck 22 and lift 26 into the compartment of an emergency vehicle.

For example, referring again to FIGS. 14-15, once deck 22 is coupled to lift 26 and is raised by lift 26 to a cot height, legs 40*a*, 40*b* are raised above the supporting floor or ground surface. If deck 22 and lift 26 are to be loaded into an emergency vehicle, such as an ambulance, head-end legs 40*b* may be pivoted so that they still remain in a deployed position, but at more of an acute angle with respect to deck 22 where they can then be used to support deck 22 (and lift 26) on the supporting floor of the emergency vehicle compartment. Once supported on the supporting floor of the emergency vehicle compartment, an EMS person can hold the foot end of deck 22 and, thereafter, collapse X-frames 52 and thereby raise the base 48 of lift 26 so that deck 22 and lift 26 may be pushed into the emergency vehicle compartment. This process can be powered. For example, person support apparatus system 20 may be pulled into the emergency vehicle using a cot loading and unloading system, such as disclosed in U.S. Pat. Nos. 8,973,654 and 7,887,113, which are incorporated herein in their entireties and commonly assigned to Stryker Corporation of Kalamazoo, Mich.

Figure 10:
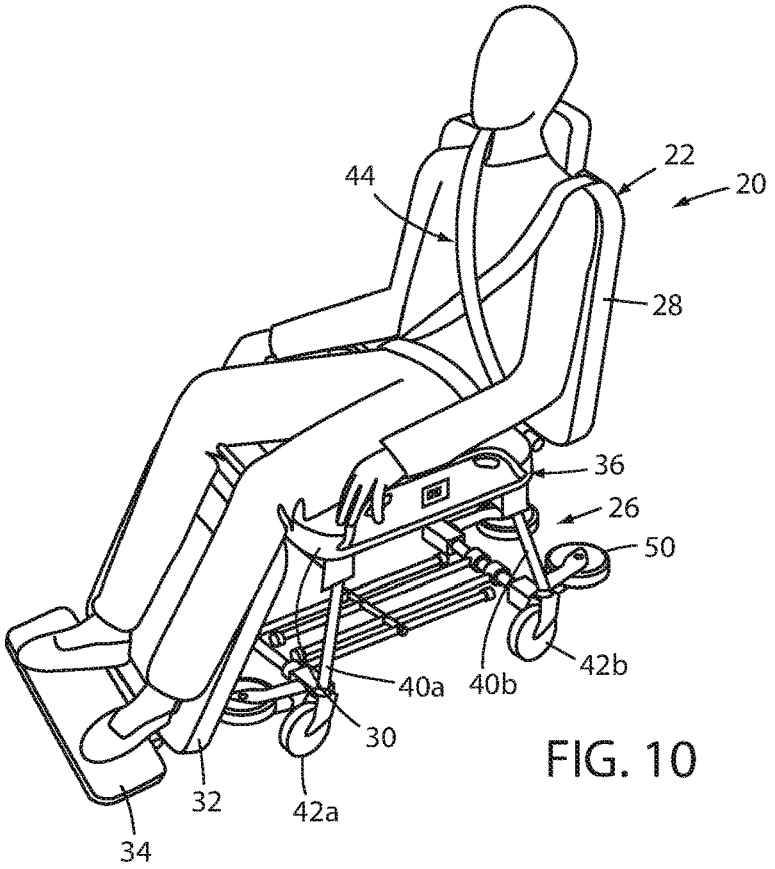
FIG. 10 is a perspective view of the person support apparatus system with the patient support apparatus reconfigured into a chair configuration and the auxiliary lift reconfigured into its compact lowered configuration.

Optionally, once deck 22 and lift 26 are loaded into an emergency vehicle, legs 40*a*, 40*b* may be moved to raise deck 22 and disengage deck 22 from lift 26 (either automatically or based on input from a control unit described below), which is already folded and collapsed into its compact configuration. Further, as best seen in FIG. 10, deck 22 may be reconfigured into a chair configuration, which may be particularly useful for patients with acute respiratory needs. Alternately, deck 22 may be left in a flat configuration, coupled or decoupled from lift 26.

In use, as best seen in FIGS. 11-15, as previously described, deck 22 of person support apparatus system 20 may be used like a backboard, with a person log rolled onto the deck. Once the person is secured using restraints 44, deck 22 may be raised above the supporting floor or ground surface by pivoting legs 40*a* and 40*b* about their respective pivot axes to an operative position where legs 40*a*, 40*b* are releasably fixed in position and can be used to transport deck 22 across a supporting floor or ground surface. In the illustrated embodiment, each foot-end leg 40*a* may be mounted so that it pivots in a counter clockwise direction (as viewed in FIG. 12), while each head-end leg 40*b* pivots in a clockwise direction (as viewed in FIG. 12). Once fully extended, as noted above, deck 22 may be reconfigured into a number of different chair configurations (FIGS. 4 and 4A), including a full chair configuration.

To facilitate coupling lift 26 to deck 22, deck 22 may include indicia, such as markings on labels, which indicate to EMS personnel when lift 26 is properly aligned under deck 22. Once lift 26 is properly aligned, X-frame members 62 may be pivoted about their respective pivot axes (e.g., by their respective drivers 64) so that couplers 60 can engage deck 22 and raise deck 22 to its cot height, such as shown in FIG. 14. Thereafter, person support apparatus system 20 can operate like an EMS cot to transport the person supported thereon to the rear opening of an emergency vehicle. As noted above, foot-end legs 40*a* may be then pivoted to their stowed positions, while head-end legs 40*b* may be pivoted to a second operation position where the wheels on legs 40*b* can engage the supporting floor of the emergency vehicle compartment. Once legs 40*b* are supported by the supporting floor of the emergency vehicle compartment, the base 48 of lift 26 may be raised so that person support apparatus system 20 can be fully inserted into the emergency vehicle compartment by EMS personnel. As noted, because the head end of deck can be fully supported by the emergency vehicle, a single EMS person may hold the foot end of deck 22 while lift 26 is folded and collapsed under the deck 22 and thereafter pushed into the emergency vehicle compartment.

Figure 1A:
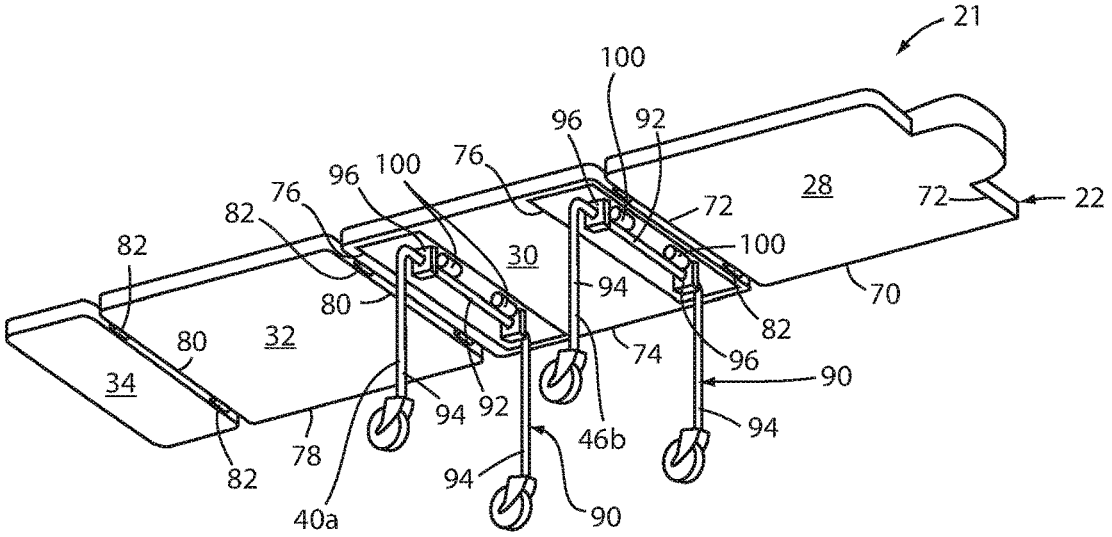
FIG. 1A is a perspective view of the person support apparatus illustrating the mounting arrangement of the legs of the primary lift to the deck.
Figure 1B:
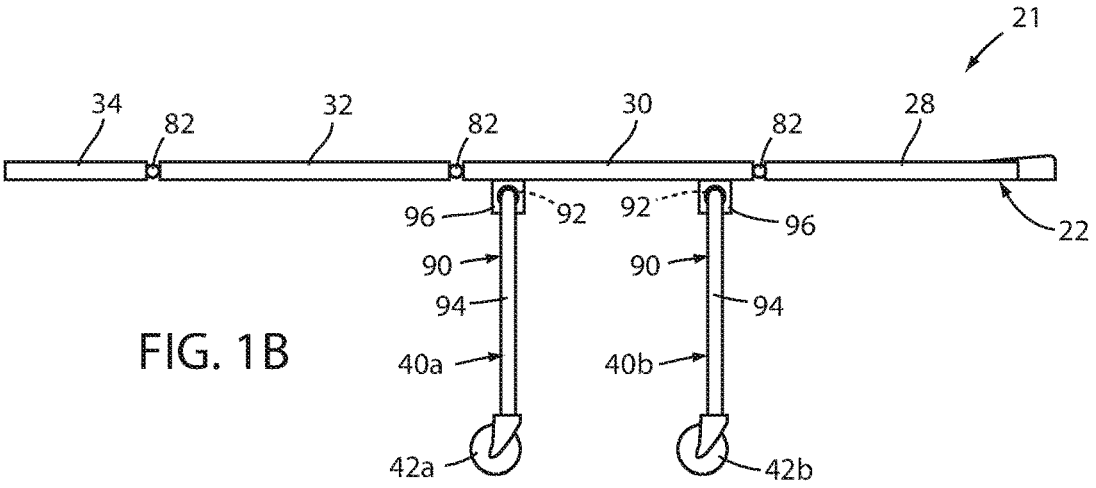
FIG. 1B is a side elevation view of the deck and primary lift of FIG. 1A.

As described above, deck 22 optionally includes head section 28, seat section 30, and leg section 32. As best seen in FIGS. 1A and 1D, head section 28 may be formed from a pair of spaced apart frame members 70, such as tubular members, which are fixed in their spaced relationship by a cross-frame member 72, such as a web (e.g. a plate) or another tubular member, for example, by welding or fastening (using conventional fasteners). Similarly, seat section 30 may be formed by a pair of spaced apart frame members 74, which may also be fixed in their spaced relationship by one or more cross-frame members 76. Leg section 32 may also be similarly formed by a pair of frame members 78, which are fixed in their spaced relationship by one or more cross-frame members 80. Similar to members 72, frame members 74 and 78 may be tubular members, and cross-frame members 76 and 80 may be webs (e.g. plates) or tubular members, which are welded or fastened to the respective frame members. Foot section 34 may be similarly constructed.

As noted above, couplers 60 may be mounted to the upper ends of X-frame members 62 or may be mounted to frame members 74 or cross-frame members 76. Similarly, frame members 74 or cross-frame members 76 may form or have mounted thereto the engagement structures, such as latch bars, for engagement by the couplers 60 when the couplers are mounted to the upper ends of X-frame members 62. The location and numbers of the couplers and engagement structures may vary. Further, the location of the couplers and engagement structures may be interchanged.

As best seen in FIGS. 1A and 1D, back section 28 is pivotally joined to seat section 30 by a pair of pivot hinges 82, whose hinge members are mounted to the respective ends of members 70 and 74, for example, by fasteners. Similarly, the proximal end 32*b* of leg section 32 is pivotally connected to the proximal end 30*b* of seat section 30 by pivot hinges 82, whose hinge members are also mounted to the respective ends of members 74 and 78. In this manner, leg section 32 and back section 28 may each be articulated relative to seat section 30. Foot section 34 may be similarly mounted to leg section 32 by a pair of pivot hinges.

Optionally, each pivot hinge (82) may be manually pivoted, with discrete locked positions defined, for example, by detent mechanisms, or may be pivoted by motors 82*a* to provide infinite positioning. For example, each pair of pivot hinges 82 may be releasably locked in position, as noted, for example, by spring biased detents that releasably engage defined slots or recesses on the opposed part of the hinge or by stopping the motor. Some exemplary locked positions for the leg section include a horizontal position and one or more downwardly angled positions. Similarly, exemplary locked positions for the back section or foot section include a horizontal position and one or more upwardly angled positions. Alternately as noted, each pivot hinge 82 may be powered as noted, for example, by a motor 82*a* and gear 82*b*. A suitable gear may include a cycloidal or planetary gear to provide infinite positioning. For examples of suitable gears and motors reference is made to co-pending U.S. Prov. Pat. Appls. Entitled PATIENT SUPPORT SYSTEMS WITH ROTARY ACTUATORS, Ser. No. 62/356,351, filed on Jun. 29, 2016; PATIENT SUPPORT SYSTEMS WITH ROTARY ACTUATORS COMPRISING NO-BACK DEVICES, Ser. No. 62/356,359, filed on Jun. 29, 2016; ROTARY ACTUATOR HAVING CLUTCH ASSEMBLY FOR USE WITH PATIENT SUPPORT APPARATUS, Ser. No. 62/356,366, filed on Jun. 29, 2016; PATIENT SUPPORT SYSTEMS WITH HOLLOW ROTARY ACTUATORS, Ser. No. 62/356,362, filed on Jun. 29, 2016; and PATIENT SUPPORT SYSTEMS WITH ROTARY ACTUATORS HAVING CYCLOIDAL DRIVES, Ser. No. 62/356,364, filed on Jun. 29, 2016, all filed by and commonly owned by Stryker Corporation of Kalamazoo, Mich., and which are incorporated herein by reference in their entireties.

In the illustrated embodiment, the gear 82*b* for the back section 28 is mounted to an intermediate frame member 70*a* of back section 28 and motor 82*a* is mounted to the seat section 30 by way of a bracket 82*c* (FIG. 1D). Similarly, the gear 82*b* for the leg section 32 is mounted to an intermediate frame member 74*a* of leg section 28 and motor 82*a* is mounted to the seat section 30 by way of a bracket (not shown).

As noted above, foot-end and head-end legs 40*a*, 40*b* are pivotally mounted to deck 22. Optionally, each leg 40*a*, 40*b* may be independently pivotally mounted to deck 22. Alternately, in one embodiment shown in FIGS. 1A and 1B, each pair (foot-end or head-end) of legs 40*a*, 40*b* may be formed from a U-shaped member 90 with a cross-member 92, such as a pivot shaft, which is rotatably mounted to deck 22 in pivot blocks or bushings 96. Legs 40*a*, 40*b* are then formed by the downwardly depending portions 94 of U-shaped member 90.

In one embodiment, legs 40*a*, 40*b* are mounted to deck 22 by manually operable drivers, such as crank and chain, crank and acme screw, or crank and direct shaft arrangements or winch/cable arrangements. In another embodiment shown in FIG. 1A, the shaft (cross-member 92) includes one or more gears 98, such as cycloidal or planetary gears, mounted at or near the opposed ends of the shaft. Each gear 98 is then driven by a motor 100 to thereby selectively drive legs 40*a*, 40*b* between their raised, stowed positions and their operative positions (described above).

It should be understood that legs 40*a*, 40*b* optionally have multiple operative positions, including a chair configuration, a loading configuration, and also a reclined position (not shown). For example, in the case of a person who should not leave the chair unattended, it may be preferably to configure deck 22 into a chair-like position where the back is reclined to an angle below upright and the leg section is partially raised.

Figure 1C:
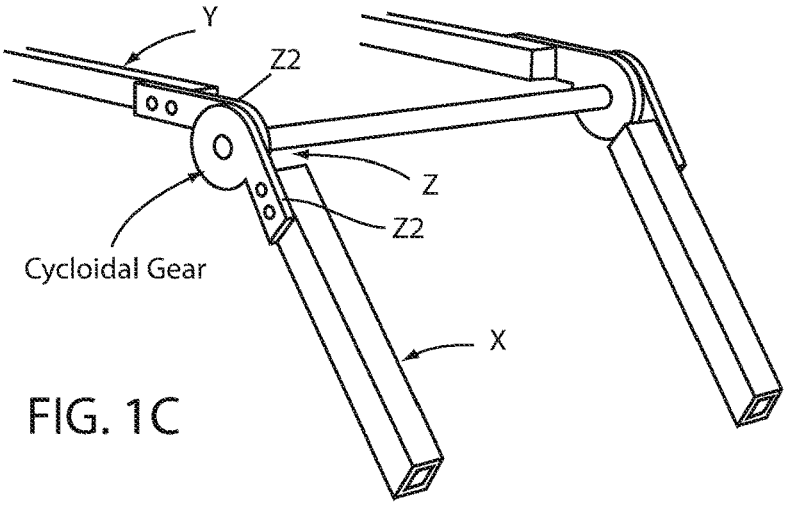
FIG. 1C is an enlarged view of one embodiment of a pivot connection that may be used between the lift legs and the deck or between any of the deck sections.
Figure 1D:
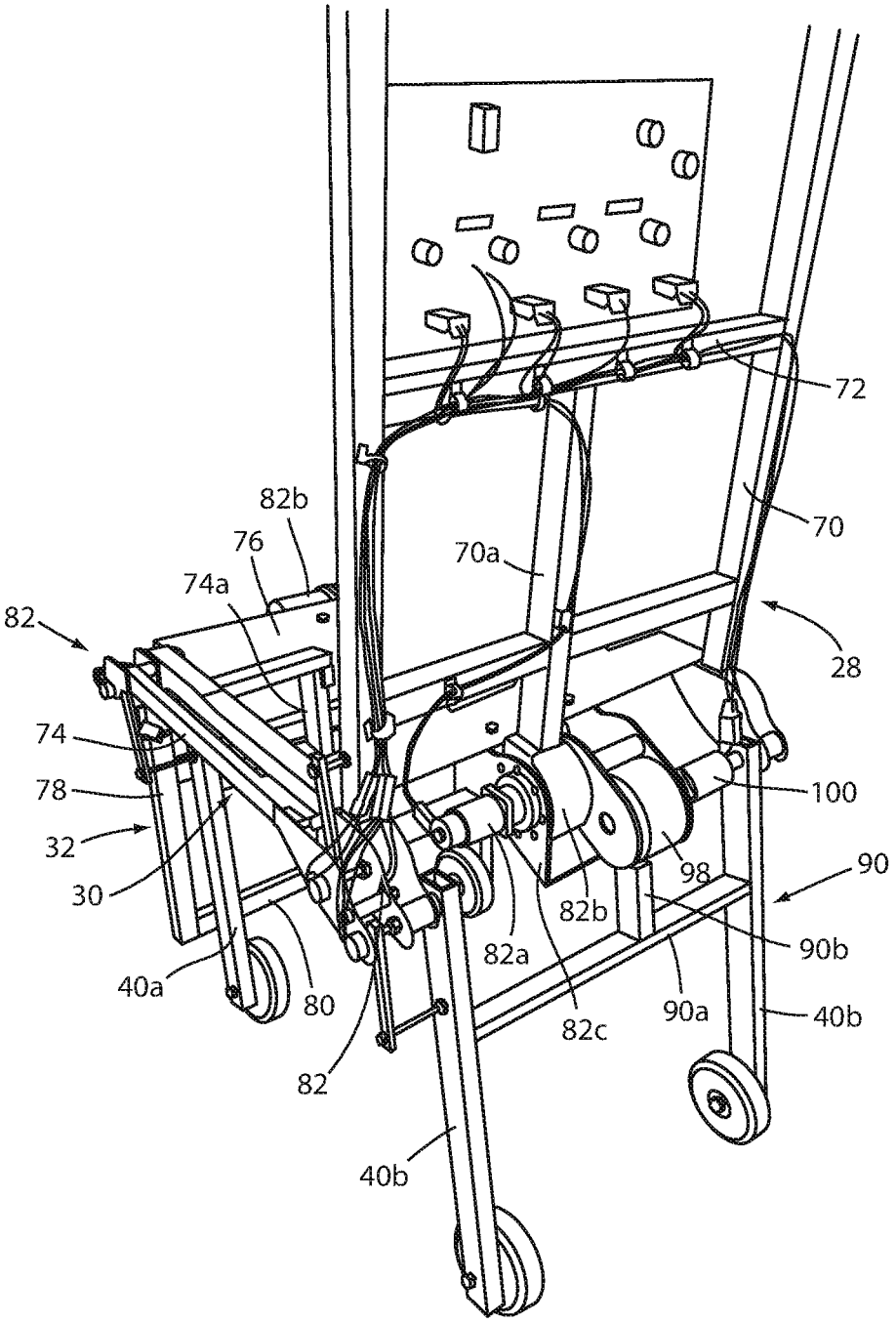
FIG. 1D is perspective view of the deck and the primary lift driver illustrating a mounting arrangement of the drivers for the deck sections and legs.
Figure 1E:
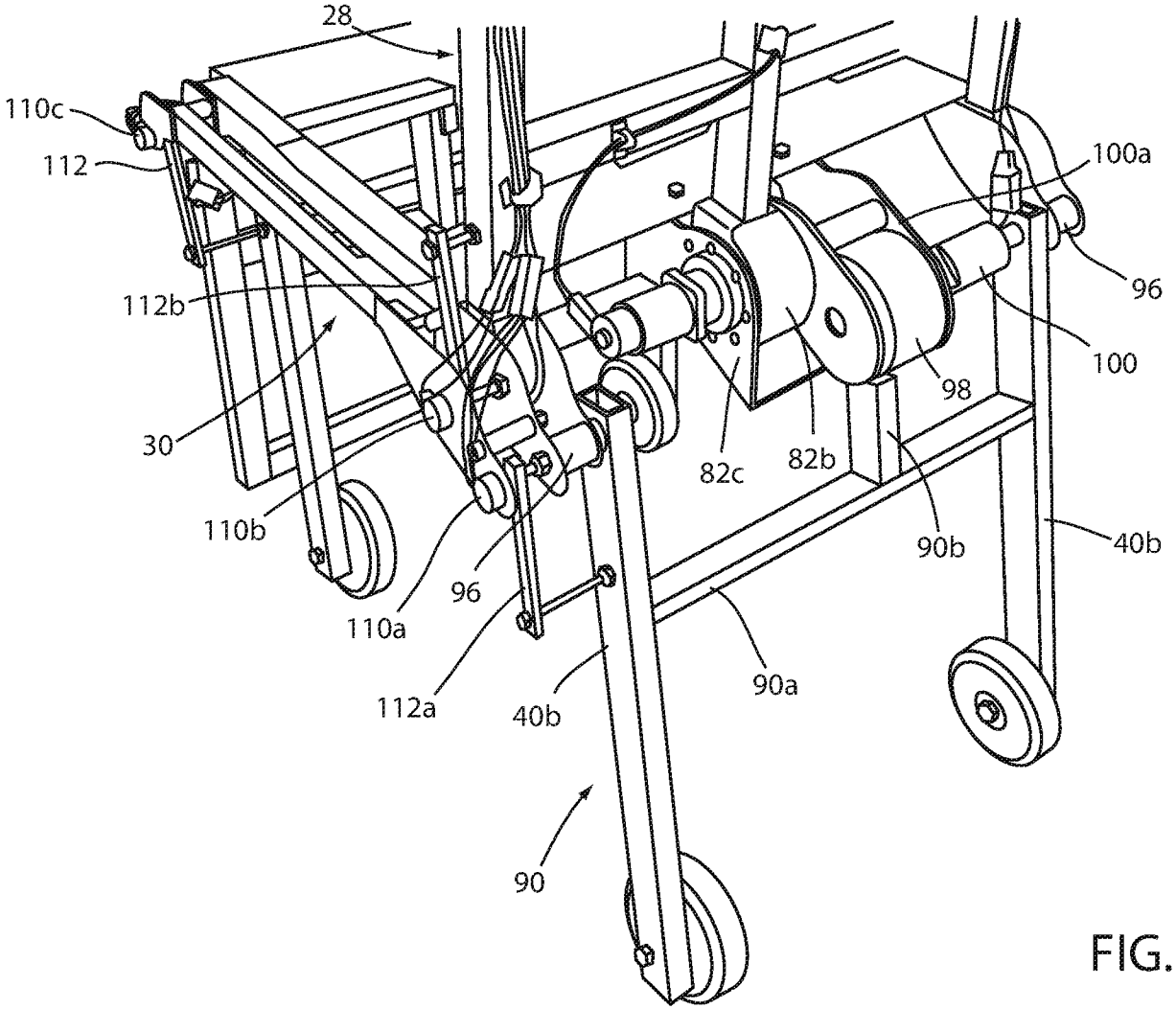
FIG. 1E is an enlarged detailed view of the deck and pivot connections between the lift legs and the deck and between the deck sections and the driver mounting arrangements.

In another embodiment shown in FIGS. 1D and 1E, a single gear 98 and motor 100 and motor may be used to drive each U-shaped member 90. U-shaped member 90 may include a transverse frame member 90*a* that is joined with (e.g. by welds or fasteners) and extends between the respective legs 40*a* or 40*b* and supports an intermediate frame member 90*b* to which gear 98 is mounted. Motor 100 is mounted to seat section 30 by a bracket 100*a*. Each pair of legs 40*a*, 40*b* is then is similarly mounted by bushings 96 to deck 22, namely to seat section 30, so that when motor 100 is powered, motor 100 will pivot the respective pair of legs 40*a* or 40*b* relative to seat section 30. Further yet, a single motor may be used to drive all four legs using a transmission and gear box, a flex cable, or a universal joint provided at each pair of legs when the pair of legs are formed, for example, by the U-shaped leg assembly described above.

In the illustrated embodiment gearboxes 82*b* and 98 are arranged in close proximity to each other. For example, as best seen in FIG. 1E, gears 82*b* and 98 are mounted by separate brackets 82*c* and 100*a* (and frame members 70*a* and 90*a*) but are stacked opposed to each other. Alternately, gears 82*b* and 98 may be mounted using a common bracket.

Referring to FIG. 1C, it should be understood that each pivot connection Z between any of the pivoting components X, Y described above, namely between the back section 28 and the seat section 30, between the seat section 30 and the leg section 32, between the foot section 34 and the leg section 32, or between any of the leg assemblies or legs 40*a*, 40*b* and the deck section, may be formed by a motor and gear, with the gear Z1 mounted to one of the components X or Y and the motor Z2, which includes a shaft for engagement by the gear, can be mounted to the other of the components X or Y. In this manner, each pivot connection and the position of each component may be controlled by the control unit described below.

In addition, any of the motors may include a sensor to determine the position of the respective component to provide feedback to the control described below. In the illustrated embodiment in FIGS. 1D and 1E, sensors 110*a*, 110*b*, 110*c* (FIG. 1E) are mounted separately from the motor and are located at each of the pivot axes so that they can detect the angular position of the respective pivoting component. Further in the illustrated embodiment, sensors 110*a*, 110*b*, and 110*c* use reference frames 112*a*, 112*b*, and 112*c*, which are mounted to the respective pivoting component to determine the position of the respective component (e.g. legs 40*a*, 40*b*, back section 28, and leg section 32).

As noted above, lift 26 couples to deck 22 so that person support apparatus system 20 may be handled like a cot. For example, each upper end of each X-frame member 62 may include coupler 60 for coupling the X-frame to the deck 22. Alternately, each upper end of each X-frame member 62 may have an engagement structure, e.g. a latch bar or the like, that is engaged by a coupler provided on deck 22. Further, as noted, the coupler may comprise a quick release coupler, including a powered quick release coupler.

To facilitate movement of lift 26 under deck 22, lift 26 may include small auxiliary wheels or rollers mounted to base 48, which engage the supporting floor or ground surface when wheels 50 are moved to their inoperative positions. For example, in one embodiment, the wheels or rollers are mounted to the downwardly facing sides of the wheels (when the wheels are rotated to their inoperative positions). For an example of suitable wheels or rollers, reference is made to U.S. Pat. No. 7,735,165, issued on Jun. 15, 2010, by Applicants Martin W. Stryker et al., and entitled SINGLE STEP WHEELCHAIR TRANSFER DEVICE (STR03 P-125A), which is incorporated by reference in its entirety herein. In this manner, in one embodiment system 20 includes three sets of wheels—a first set of wheels 42*a*, 42*b* on legs 40*a*, 40*b*, a second set of wheels 50 (caster wheels) supported on base 48, and a third set of wheels on lift 26 to facilitate movement of base 48 when wheels 50 are in their inoperative positions.

As previously described, deck 22 may include side rails 36. Side rails 36 may comprise an open frame construction and formed from metal frame members that, for example, form a four bar linkage with seat section 30 so that they may be collapsed alongside seat section 30. Reference is made to U.S. Pat. No. 7,412,734, issued on Aug. 19, 2008, entitled BED SIDERAIL (STR03B P-122A) for an example of a suitable collapsible side rail, which is incorporated herein in its entirety. Alternately, side rails 36 may comprise side rails that are pivotally mounted to the opposed sides of seat section 30. For example, in one embodiment, side rails 36 are constructed as shown in U.S. patent application Ser. No. 29/546,441, filed Nov. 23, 2015 by Applicants Clifford Edwin Lambarth et al, entitled EMERGENCY COT AND SIDE RAILS (STR03A P-346A), and which is incorporated by reference in its entirety herein. In this form, side rails 36 may pivot outwardly from seat section 30 and, therefore, extend the width of seat section 30 when side rails 36 are pivoted to their open or expanded configuration. Optionally, side rails 36 may be formed or covered from the same materials forming or covering seat section 30, described below.

For example, each section 28, 30 and 32 (and foot section 34) may be formed from a web (e.g. a thin plate) or frame and, further, include a pad, including a foam pad, a gel pad or a combination of both, and/or a fabric cover, such as a stretch fabric, which is applied over the frame members (or web) forming the respective deck section. Side rails 36 may include the same or similar covering. For example, when formed from a web, the deck section may be constructed from a honeycomb or corrugated metal, such as aluminum, so that the deck section will be able to carry large loads, for example, in the case of a bariatric patient.

Alternately, side rails 36 may be formed from metal frames over molded with plastic and, further, have regions of cushioning material, such as gel molded thereon or therein, using co-injection-molding or applied using an adhesive. Suitable gel materials for forming the gel pad or cushioning material may be formed by blending an A-B-A triblock copolymer with a plasticizer oil, such as mineral oil. The "A" component in the A-B-A triblock copolymer is a crystalline polymer like polystyrene and the "B" component is an elastomer polymer like poly(ethylene-propylene) to form a SEPS polymer, a poly (ethylene-butadyene) to form a SEBS polymer, or hydrogenated poly(isoprene+butadiene) to form a SEEPS polymer. For examples of suitable gels for covering or being applied to any of the deck sections, or for covering or being applied to the side rails reference is made to U.S. Pat. Nos. 3,485,787; 3,676,387; 3,827,999; 4,259,540; 4,351,913; 4,369,284; 4,618,213; 5,262,468; 5,508,334; 5,239,723; 5,475,890; 5,334,646; 5,336,708; 4,432,607; 4,492,428; 4,497,538; 4,509,821; 4,709,982; 4,716,183; 4,798,853; 4,942,270; 5,149,736; 5,331,036; 5,881,409; 5,994,450; 5,749,111; 6,026,527; 6,197,099; 6,843,873; 6,865,759; 7,060,213; 6,413, 458; 7,730,566; 7,823,233; 7,827,636; 7,823,234; and 7,964,664, which are all incorporated herein by reference in their entireties.

Other formulations of gel materials may also be used in addition to those identified in these patents. As one example, the gel material may be formulated with a weight ratio of oil to polymer of approximately 3.1 to 1. The polymer may be Kraton 1830 available from Kraton Polymers, which has a place of business in Houston, Tex., or it may be another suitable polymer. The oil may be mineral oil, or another suitable oil. One or more stabilizers may also be added. Additional ingredients—such as, but not limited to—dye may also be added. In another example, the gelatinous elastomeric material may be formulated with a weight ratio of oil to copolymers of approximately 2.6 to 1. The copolymers may be Septon 4055 and 4044 which are available from Kuraray America, Inc., which has a place of business in Houston, Tex., or it may be other copolymers. If Septon 4055 and 4044 are used, the weight ratio may be approximately 2.3 to 1 of Septon 4055 to Septon 4044. The oil may be mineral oil, and one or more stabilizers may also be used. Additional ingredients—such as, but not limited to—dye may also be added. In addition to these two examples, as well as those disclosed in the aforementioned patents, still other formulations may be used.

Further, in addition to providing covers or pads for the various sections of the deck 22, deck 22 may also incorporate a cushion 102 for a person's head. Cushion 102 may be similarly formed from foam or gel (and covered with a fabric) and, further, may be removable (e.g. by fasteners, such as VELCRO strips) so that in the event, for example, a person is wearing a neck or head brace or collar during transport, the cushion can be removed so that it will not interfere with the collar or brace.

As noted above, person support apparatus system 20 optionally includes one or more powered components—all of which may be controlled locally, for example, by way of a user interface, or controlled remotely, for example, by a hand-held user interface or from an interface in an emergency vehicle. In one embodiment, person support apparatus system 20 includes a control unit 110 (FIG. 3, shown mounted in side rail 36) with one or more user input devices, such as buttons, or a touch screen, to enable a user to control the various powered components, including the referenced drivers, such as the motors or solenoids, or other control circuitry for operating any hydraulic or pneumatic components or electromagnets. As noted, the control unit 110 may be mounted to system 20 or comprise a hand-held device (FIG. 3) to allow remote communication with an onboard processor, for example located in the side rail or in one of the deck sections, to control of the various powered components.

In one embodiment, the remote control unit uses the communication systems described in U.S. patent application Ser. No. 14/211,613, filed on Mar. 14, 2014, by Applicants Michael Joseph Hayes et al., entitled PATIENT SUPPORT APPARATUS WITH REMOTE COMMUNICATIONS (STR03 P-414B), which is incorporated by reference herein in its entirety.

Figure 20:
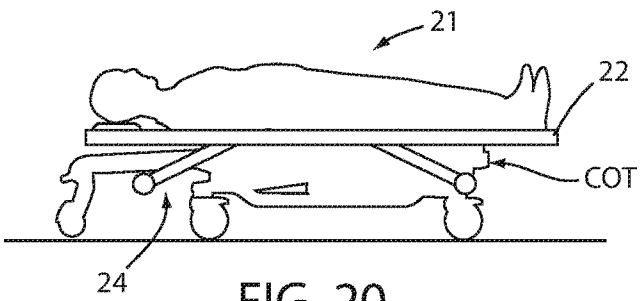
FIG. 20 is a similar view to FIG. 19 with the primary lift raised to allow the deck to rest on the emergency cot.
Figure 19:
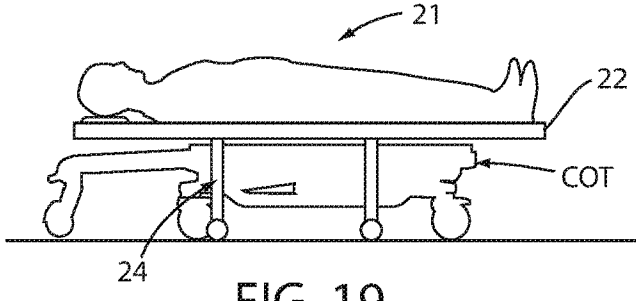
FIG. 19 is a similar view to FIG. 18 with an emergency cot positioned under the person support apparatus.
Figure 21:
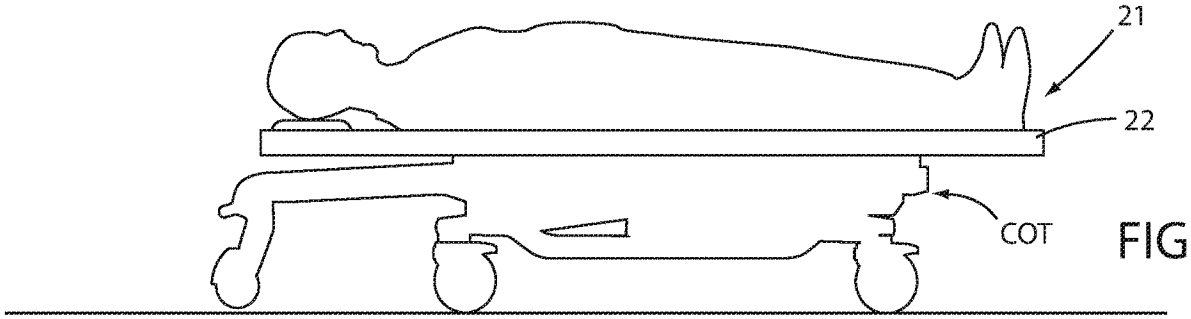
FIG. 21 is a similar view to FIG. 20 with the primary lift fully raised.

Referring to FIGS. 16-21, the person support apparatus may be used in conjunction with an EMS cot. For example, after the person support apparatus is moved from its fully lowered position (FIG. 16), where primary lift 26 is fully raised such that deck 22 may rest on the supporting floor or ground surface where a patient can be log rolled onto the deck, primary lift 26 may then raise the deck 22 off the supporting floor or ground surface to a fully raised position (FIG. 18) where an EMS cot may be extended under the deck 22 between the legs of the primary lift 26. Once the emergency cot is positioned under the deck 22 of the person support apparatus, primary lift 26 may be raised (FIGS. 20 and 21). Optionally, deck 22 may be coupled to or simply rest on the EMS cot, and thereafter moved by the wheels of the EMS cot for loading into an emergency vehicle for transport.

Accordingly, the person support apparatus and the person support apparatus system described herein can facilitate handling of a patient while reducing the strain or stress on a caregiver.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

We claim:

1. A person support apparatus system comprising:

a deck having a seat section, a leg section, and a back section, and said back section and said leg section each pivotally mounted to said seat section and being reconfigurable between a cot configuration where said back section, said seat section, and said leg section are arranged to support a person in a supine position and a chair configuration where said back section and said leg section are angled relative to seat section to support a person in a sitting position;

a primary lift mounted to said deck to raise said deck relative to a supporting floor or ground surface from the supporting floor or ground surface to a first primary lift height and to a maximum second primary lift height wherein said leg section can be moved to said chair configuration without interference from the supporting floor or ground surface;

an auxiliary lift reconfigurable between a first configuration and a second configuration and positionable under said deck when said auxiliary lift is in said first configuration, said first configuration having a first auxiliary lift height, said second configuration having a second auxiliary lift height to raise said deck when positioned under said deck to a transport height, and said second auxiliary lift height being greater than said first auxiliary lift height and greater than said maximum second primary lift height, and said auxiliary lift operable to raise said deck and said primary lift off the supporting floor or ground surface when said auxiliary lift is reconfigured to said second configuration to raise deck and said primary lift to the transport height for loading the person support apparatus into an emergency vehicle; and wherein when said auxiliary lift is reconfigured to said second configuration said auxiliary is configured to provide sole support for said deck.

2. The person support apparatus system according to claim 1, further comprising a coupler mounted to or an engagement structure provided at said deck to releasably couple said deck to said auxiliary lift.

3. The person support apparatus system according to claim 2, wherein said coupler or said engagement structure comprises a manually operable release or an electrically powered release.

4. The person support apparatus system according to claim 2, wherein said coupler or said engagement structure comprises a pair of couplers, and said pair of couplers are mounted to said seat section of said deck.

5. The person support apparatus system according to claim 1, wherein said deck further includes a foot section.

6. The person support apparatus system according to claim 1, wherein said auxiliary lift is configurable between a third configuration having a third auxiliary lift height greater than said first auxiliary lift height and less than said second auxiliary lift height.

7. The person support apparatus system according to claim 1, wherein said auxiliary lift comprises a pair of X-frames.

8. The person support apparatus system according to claim 1, wherein said first primary lift height is greater than said first auxiliary lift height of said auxiliary lift to allow said auxiliary lift to be positioned under said deck when said auxiliary lift is in said first configuration.

9. The person support apparatus system according to claim 8, wherein said primary lift includes one or more wheels, and said primary lift forms therein a space between said wheels sized to receive said auxiliary lift, wherein said deck may be moved over said auxiliary lift between said wheels of said primary lift when said deck is raised to a height equal to or greater than said first primary lift height and when said auxiliary lift is in said first configuration.

10. The person support apparatus system according to claim 8, wherein said auxiliary lift includes one or more wheels, and said primary lift forms a space therein, said space sized to receive said auxiliary lift when said auxiliary lift is in said first configuration, wherein said auxiliary lift may be moved under said deck in said space when said deck is raised to a height equal to or greater than said first primary lift height and when said auxiliary lift is in said first configuration.

11. The person support apparatus system according to claim 8, wherein said primary lift comprises two pair of legs, each pair of legs is pivotally mounted to said seat section of said deck for movement between a first orientation wherein said pair of legs are in a folded position and a second orientation wherein said pair of legs are in an unfolded position.

12. The person support apparatus system according to claim 11, wherein each leg includes a wheel.

13. The person support apparatus system according to claim 2, wherein said coupler or said engagement structure comprises a first coupler or a first engagement structure, said auxiliary lift includes a second engagement structure or a second coupler to be engaged by said first coupler or engage said first engagement structure on said deck.

14. The person support apparatus system according to claim 1, wherein said auxiliary lift includes a base and a plurality of caster wheels mounted to said base, each caster wheel rotatably mounted to said base about a horizontal axis wherein said caster wheels may be moved between (1) non-operative positions wherein said caster wheels are positioned for disengagement from the supporting floor or ground surface and (2) operative positions wherein the caster wheels are positioned for engagement with the supporting floor or ground surface.

15. The person support apparatus system according to claim 1, further comprising side rails mounted to said seat section.

16. The person support apparatus system according to claim 15, wherein each side rail is pivotally mounted to said seat section and movable between a raised position and a lowered position.

17. The person support apparatus system according to claim 1, wherein said back section is generally upright with respect to said seat section when in said chair configuration.

18. A person support apparatus system comprising:

a deck, said deck having a seat section, a back section, and a leg section, said back section and said leg section each being articulatable relative to said seat section, and said deck being reconfigurable between a cot configuration where said back section, said seat section, and said leg section are arranged to support a person in a supine position and a chair configuration where said back section and said leg section are angled relative to said seat section to support a person in a sitting position;

a primary lift mounted to said seat section of said deck to raise said deck relative to a supporting floor or ground surface to a height wherein said leg section can be pivoted relative to said seat section to said chair configuration without interference with the supporting floor or ground surface;

an auxiliary lift selectively positionable under said seat section of said deck and configured to lift said deck and said primary lift relative off the supporting floor or ground surface to raise said deck and said primary lift to a transport height for loading into an emergency vehicle;

a coupler mounted to (1) said deck or (2) said auxiliary lift; and an engagement structure formed or mounted to the other of (1) said deck or (2) said auxiliary lift to cooperate with said coupler to releasably couple said deck to said auxiliary lift when said auxiliary lift is positioned under said seat section of said deck.

19. The person support apparatus system according to claim 18, wherein said leg section has a proximal end pivotally mounted to said seat section and a distal cantilevered end spaced a first distance from said proximal end, and said seat section, said leg section, and said back section being arranged to lie in a common plane when said deck is in said cot configuration to support a person in the supine position; and said primary lift being configured to raise said deck relative to the supporting floor or ground surface when said deck is in said cot configuration to a maximum height less than said first distance.

20. The person support apparatus system according to claim 18, wherein said auxiliary lift includes caster wheels, each caster wheel being mounted to move between an operative position to engage the supporting floor or ground surface and a non-operative position to disengage from the supporting floor or ground surface.

21. The person support apparatus system according to claim 20, wherein said caster wheels move between their non-operative positions to their operative positions under the force of gravity.

22. The person support apparatus system according to claim 20, further comprising (1) one or more couplers to move said caster wheels between their operative positions and their non-operative positions or (2) at least one or more depending members at said deck to urge said caster wheels to move between their operative positions and their non-operative positions.

23. The person support apparatus system according to claim 20, wherein further comprising magnets to hold said caster wheels in their non-operative positions.

24. The person support apparatus system according to claim 20, wherein each respective caster wheel of said caster wheels includes a driver to move said respective caster wheel between its non-operative position and its operative position.

25. The person support apparatus system according to claim 24, wherein said drivers each comprise a driver selected from the group consisting of a motor, a solenoid, a hydraulic cylinder, and a magnet.

* * * * *